US005704619A

United States Patent [19]

Mitchell et al.

[11] Patent Number: 5,704,619

[45] Date of Patent: Jan. 6, 1998

[54] SLIDABLE SKATE BRAKE AND METHODS

[75] Inventors: David N. Mitchell, Englewood; Gregory C. Sturgeon, Brighton, both of Colo.

[73] Assignee: Out of Line Sports, Inc., Englewood, Colo.

[21] Appl. No.: 664,068

[22] Filed: Jun. 13, 1996

Related U.S. Application Data

[63] Continuation-in-part of Ser. No. 535,326, Sep. 27, 1995, which is a continuation of Ser. No. 295,473, Aug. 24, 1994, abandoned, which is a continuation of Ser. No. 62,407, May 14, 1993, abandoned, which is a continuation-in-part of Ser. No. 830,609, Feb. 4, 1992, Pat. No. 5,211,409, which is a continuation-in-part of Ser. No. 934,166, Aug. 24, 1992, Pat. No. 5,253,882.

[51] Int. Cl.[6] ..... A63C 17/14

[52] U.S. Cl. ..... 280/11.2; 280/11.22

[58] Field of Search ..... 280/11.19, 11.2, 280/11.22; 188/5, 6, 7

[56] References Cited

U.S. PATENT DOCUMENTS

| | | | |
|---|---|---|---|
| 341,186 | 5/1886 | Tilden | 280/11.2 |
| 922,774 | 5/1909 | Kennedy . | |
| 979,169 | 12/1910 | Kennedy . | |
| 1,456,881 | 5/1923 | Carley . | |
| 1,497,224 | 6/1924 | Ormiston . | |
| 1,524,286 | 1/1925 | Bried . | |
| 2,208,888 | 7/1940 | Whited . | |
| 3,112,119 | 11/1963 | Sweet . | |
| 3,528,672 | 9/1970 | Wunder . | |
| 3,844,574 | 10/1974 | Kosono et al. . | |
| 4,003,582 | 1/1977 | Maurer . | |
| 4,033,596 | 7/1977 | Andorsen et al. . | |
| 4,054,296 | 10/1977 | Sullins . | |
| 4,061,348 | 12/1977 | Carter . | |
| 4,088,334 | 5/1978 | Johnson . | |
| 4,094,524 | 6/1978 | Carroll . | |
| 4,099,734 | 7/1978 | Lowery . | |
| 4,108,451 | 8/1978 | Scheck, Sr. . | |
| 4,167,225 | 9/1979 | Fragoso . | |
| 4,275,895 | 6/1981 | Edwards | 280/11.2 |
| 4,295,547 | 10/1981 | Dungan . | |
| 4,363,493 | 12/1982 | Veneklasen . | |
| 4,453,726 | 6/1984 | Ziegler . | |
| 4,807,893 | 2/1989 | Huang . | |
| 4,951,958 | 8/1990 | Chao . | |
| 5,052,701 | 10/1991 | Olson . | |
| 5,067,736 | 11/1991 | Olson et al. | 280/11.2 |

(List continued on next page.)

FOREIGN PATENT DOCUMENTS

| | | |
|---|---|---|
| 379906 | 8/1990 | European Pat. Off. . |
| 330 043 | 6/1976 | Germany . |
| 27 23 107 | 11/1978 | Germany . |
| 29 25 555 | 1/1981 | Germany . |
| 104127 | 4/1924 | Switzerland . |

OTHER PUBLICATIONS

Transcript of the Deposition of David N. Mitchell, Sr., pp. 94–125.

Transcript of the Deposition of Ivan Histand, pp. 36–46.

(List continued on next page.)

*Primary Examiner*—Eric D. Culbreth

*Attorney, Agent, or Firm*—Townsend and Townsend and Crew LLP

[57] ABSTRACT

The invention provides systems and methods for slowing or stopping a roller skate. In one exemplary system, a roller skate is provided having a frame with a longitudinal axis, a piece of footgear securely attached to the frame, and a plurality of wheels operably attached to the frame in alignment with the longitudinal axis. A braking mechanism is operably attached to the roller skate, with the braking system having a braking pad in alignment with the longitudinal axis. The braking pad is movable between a first position above a skating surface and a second position in contact with the skating surface. An actuator is provided which moves the braking pad between the first and the second positions while the angle of the skate relative to the skating surface remains constant.

18 Claims, 21 Drawing Sheets

U.S. PATENT DOCUMENTS

| | | | |
|---|---|---|---|
| 5,068,956 | 12/1991 | Malewicz . | |
| 5,088,748 | 2/1992 | Koselka et al. . | |
| 5,211,409 | 5/1993 | Mitchell et al. . | |
| 5,253,882 | 10/1993 | Mitchell . | |
| 5,316,325 | 5/1994 | Mitchell et al. . | |
| 5,330,207 | 7/1994 | Mitchell . | |
| 5,397,137 | 3/1995 | Pellegrini, Jr. et al. | 280/11.2 |
| 5,435,579 | 7/1995 | Pozzobon | 280/11.2 |
| 5,486,012 | 1/1996 | Olivieri | 280/11.2 |

OTHER PUBLICATIONS

Transcript of the Oct. 10, 1994, Hearing In Out Of Line Sports, Inc. v. Rollerblade, Inc., Civil Action No. 94–Z–1284, District of Colorado.

Declaration of Dal Niggemann, *Mitchell v. Niggeman*, in the United States Patent and Trademark Office before the Board of Patent Appeals and Interferences, Interference No. 103, 666.

Declaration of Susan Niggemann, *Mitchell v. Niggeman*, in the United States Patent and Trademark Office before the Board of Patent Appeals and Interferences, Interference No. 103,666.

Declaration of Michael Cichanowski, *Mitchell v.Niggeman*, in the United Sttes Patent and Trademark Office before the Board of Patent Appeals and Interferences, Interference No. 103,666.

"Stop Roller Skiing—Local Inventor Has Developed A Roller Ski With A Brake—And It Actually Works" by Lee Borowski, Published in Silent Sports, Nov. 1991.

"Roller Ski with Confidence" Advertisement Published in Silent Sports, Nov. 1991.

"Roller Ski with Confidence" Advertisement Published in Silent Sports, Oct. 1991.

Deposition of Dale Allen Niggeman, Oct. 11, 1994, pp. 41–44, 149–152, 113–124, and Exhibit 3, *Out of Line Sports, Inc. v. Rollerblade,Inc.*, Civil Action No. 94–Z–1284, Dist. Ct. of Colo.

SLIDABLE SKATE BRAKE AND METHODS

CROSS-REFERENCE TO RELATED APPLICATIONS

This application is a continuation in part of U.S. patent application Ser. No. 08/535,326, filed Jan. 25, 1996, which is a continuation of U.S. patent application Ser. No. 08/295,473, filed Aug. 24, 1994, now abandoned, which is a continuation of U.S. patent application Ser. No. 08/062,407, filed May 14, 1993, now abandoned, which is a continuation-in-part application of U.S. patent application Ser. No. 07/830,609, filed Feb. 4, 1992, now U.S. Pat. No. 5,211,409 and a continuation-in-part application of U.S. patent application Ser. No. 07/934,166, filed Aug. 24, 1992, now U.S. Pat. No. 5,253,882. The complete disclosures of all these references are hereby incorporated by reference.

FIELD OF THE INVENTION

This invention relates to roller skate brakes, and more particularly to a roller skate brake which is remotely activated and stops the skate by applying friction to the ground rather than to a wheel of the skate. The invention has particular utility for use with "in-line" skates and other modern skates that attain high speeds and are used in areas with pedestrians, automobiles and other hazards.

BACKGROUND OF THE INVENTION

Traditional roller skates, having sets of wheels in tandem, have long been used in the relatively controlled environment of a skating rink. in a skating rink, the skating surface is typically flat and smooth, skaters travel in the same direction around an oval or circular track, and there are few unexpected hazards. There has been, therefore, little need for an effective brake on a traditional roller skate.

Relatively recently, a faster and more maneuverable type of roller skate has been introduced. These skates, known as "in-line" skates because the wheels are mounted in a line rather than in tandem, act much as an ice skate. In-line skates are offered in the United States by several vendors, including Rollerblade, Veraflex, Bauer, and California Pro. In-line skates have appealed to the athletic adult and young adult, and to persons who enjoy the outdoors. Such skates are commonly used outside, on uneven sidewalks, bicycle paths, and roads. Skaters can achieve high speeds and can become a hazard to themselves and others when skating more rapidly than conditions allow. There is a need for an effective brake for in-line skating to become a sport that is safe as well as enjoyable.

A brake commonly used on in-line skates involves a fixed friction pad that extends behind the heel of the skate. The fixed friction pad is disposed above the skating surface and is made to swing down towards the skating surface by the skater's pivoting the skate about the axis of the rear wheel. As the skater does so, raising the toe of the skate and rotating the heel downward, the friction pad behind the heel will contact the ground and stop the skate. Such systems have also been used on tandem wheeled skates, and, because the speeds are not so high, can involve a fixed friction pad that extends in front of the toe of the skate. In this case, the skater brings the friction pad to bear on the skating surface by raising the heel and lowering the toe.

Examples of these physically activated (toe-raised, or toe-lowered) brakes include those described in U.S. Pat. Nos. 2,901,259 (tandem wheeled skates, brake member in the toe section, braking performed by lowering the toe); 4,313,610 of Volk (a friction-damped wheel in the heel section, braking performed by raising the toe); 4,865,342 of Kong (for a skate board). The adaptation of such a brake for use with an in-line skate is shown in U.S. Pat. Nos. 4,394,028 of Wheelwright; 4,418,929 of Gray; 4,909,523 of Olson; 5,052,701 of Olson; and 5,067,736 of Olson.

Disadvantages of the physically activated, toe-raised (or lowered), brakes include these: (a) the braking maneuver requires the exercise of thigh muscle strength, and a skater's fatigue will make the maneuver more difficult to perform, (b) the braking maneuver requires the skater to place himself or herself in an awkward position, and a skater's lack of dexterity or balance will make the maneuver difficult to perform, especially if the skater is moving at relatively high speed or encounters an unexpected hazard, and (c) such brakes can only be used on one skate, effectively halving the potential stopping force available.

It may be said, in general, that an inexperienced skater finds it very intimidating to move his or her foot through such a large arc that he or she must jeopardize their balance in order to apply the brake. This has made many potentially new skaters reluctant to take up the sport at all.

There has been much interest in attempting to solve the problems of toe-raised (or lowered) brakes so as to make in-line skating a sport that can be enjoyed by other than the young, the fit, or the reckless. Current attempts to do so have been directed towards replacing the physically-activated brake with a remotely activated device. There have been attempts to mount a caliper or disc brake adjacent to the side or tread of one of the wheels of the skate. A hand lever-and—cable system can be used by the skater to apply friction pressure to the side or to the tread of the wheel, and the skate can be made to stop without the need for special body movement by a skater.

Examples of these remotely activated (wheel based) brakes include those described in U.S. Pat. Nos. 4,295,547 of Dungan; 4,312,514 of Horowitz et al.; 4,943,075 of Gates; and 4,943,072 of Henig.

Disadvantages of trying to use the wheel of an inline skate for stopping include these: (a) the amount of contact that a wheel can have with the skating surface is very small when compared to the amount of contact that a friction pad behind the skate could have, (b) because in-line skate wheels encounter considerable wear, and the wear is uneven, it is possible that the wheel selected for braking may have little, or no, contact with the ground, (c) heat generated by the rubbing of a brake pad on the wheel may cause the wheel to break down and fall apart, (d) the wheel selected for braking may develop flat spots and cause rough skating, and (e) the replacement cost of a skate wheel is high compared to the cost of replacing a friction pad behind the skate.

Thus, there are two general kinds of brake systems currently available. The first kind of brake stops the skate by using a physical maneuver to bring a pad into contact with the skating surface (toe-raised or toe-lowered brakes). The second kind of brake stops the skate by using a remotely activated device to bring a pad into contact with a wheel of the skate (wheel-based brakes).

There are also some composite brakes, in which a physical maneuver is used both to bring a pad into contact with the skating surface and to bring another pad into contact with a wheel of the skate. Examples are described in U.S. Pat. No. 4,807,893 of Huang (brake member in the heel section, braking performed by depressing the heel); and in U.S. Pat. No. 4,453,726 of Ziegler. Composite brakes of this kind still fall into the general category of toe-raised or toe-lowered brakes and share all of the previously discussed disadvantages of the physically activated brake.

Despite the work which has been done to develop an optimum in-line skate brake, each of the existing brakes has problems. Either they are difficult to use (that is, the physically activated, toe-raised or toe-lowered brakes), or they offer relatively small effective stopping force (that is, the mechanically activated, wheel-based brakes). Accordingly, it can be seen that there is a need for an in-line skate brake that better meets the needs of a skater.

The desired in-line skate brake should have a relatively large effective area in contact with the skating surface so as to maximize the effective stopping power of the brake. In addition, the desired in-line skate brake should permit an independent selection of the material for the portion that is in effective contact with the skating surface. That is, this important portion of the brake assembly should be selected without regard to factors other than its effectiveness (durability, coefficient of friction, and so on) for stopping the skate. These concerns suggest that the desired brake will not be a wheel-based brake in which the only area in contact with the ground is the wheel and in which the material in effective contact with the ground must be the same material as is used in the wheel itself.

The desired in-line skate brake should be capable of being fitted to both skates, rather to just one skate, so as to double the effective braking surface area in contact with the skating surface. In addition, the desired in-line skate brake should use the skater's hand, rather than his or her foot or leg, to activate the movement of the braking pad. Using the hand to activate the brake will allow the skater to use his or her total body, including hands, to maintain good balance at all times, including times when the skater needs to slow down or stop and when the need for balance may be greatest. These concerns suggest that the desired brake will not be a toe-raised or toe-lowered brake.

In addition, the desired in-line skate brake should be capable of being retrofitted to most existing skates and should be capable of being installed as original equipment by skate manufacturers at reasonable cost. If the skate brake is mechanically activated, it should have a secondary, or "emergency," brake that can be used in the event of mechanical failure of the primary activator. If a cable-and-hand lever activator is used, it should have some means for conveniently retaining the cables and hand levers.

It is a specific object of the current invention to provide a brake system that is remotely activated, that uses the skating surface (rather than a wheel of the skate) for generating stopping force while the angle of the skate relative to the ground remains constant, that has a large effective area in contact with the skating surface, that can be fitted to both skates, that allows for an independent selection of the material in contact with the braking surface, that incorporates an emergency brake, that can be readily installed in new or used skates, and that conveniently retains all cables and hand-levers which are a part of the system. These, and other advantages, of the brake system of this invention will become apparent in the remainder of this disclosure.

U.S. patent application Ser. No. 07/830,609 (of which this is a continuation-in-part) discloses a hand-activated brake system that accomplishes the foregoing objects and which describes a brake delivery mechanism including a rocker arm. U.S. patent application Ser. No. 07/934,166 (of which this is also a continuation-in-part) discloses two other brake delivery mechanisms: one that includes a wrap around brake carriage; and another that includes a plunger.

The present invention discloses additional brake delivery mechanisms, including a side rail mechanism and an integrated mechanism. The present invention also discloses various other embodiments, improvements and refinements of the skate brake systems described, and it also discloses a method of fitting the brake systems to an in-line skate.

Although the devices of this disclosure are directed towards the newer "in-line" skates, it should be understood that the brake systems of this invention may be readily adapted to the traditional tandem skates, skate boards, ski skates, and to other skating devices.

SUMMARY OF THE INVENTION

The brake system of this invention is most broadly characterized as being (a) ground engaging, and (b) movable. That is to say, the brake system engages the ground so as to use the ground (rather than a wheel of the skate) for generating stopping force. Further, a delivery mechanism of the brake system moves relative to the skate so as to drive a braking surface to the ground while the angle of the skate relative to the ground remains constant.

In summary, the ground engaging movable brake system of this invention includes at least some of the following basic component elements: (1) a delivery mechanism for driving a brake surface to the ground; (2) a variable force mechanism for providing an increased mechanical advantage to the delivery mechanism or otherwise enhancing the performance of the system; (3) an arresting mechanism to provide an emergency back-up in the event that the delivery mechanism should fail; (4) a brake surface driven to the ground by the delivery mechanism; and (5) an actuator mechanism for activating the delivery mechanism. As will be seen, each of the various component elements will be described in several embodiments, and complete brake systems combining certain of the elements will be described in such a way that other combinations of the elements will become clear to those skilled in the art.

The delivery mechanism of this invention is the device that drives the brake surface to the ground. Five embodiments of the delivery mechanism will be referred to as: (a) a rocker arm, (b) a carriage, (c) a plunger, (d) a side rail, and (e) an integrated unit. Other delivery mechanisms will also be described.

The variable force mechanism of this invention enhances the operation of the delivery mechanism. Among the specific embodiments of the variable force mechanism discussed herein are ones that incorporate a lever, a cam, a pulley, and/or a worm gear.

The arresting mechanism provides an emergency back-up in the event that the delivery mechanism should fail. The most basic version of the arresting mechanism is a post disposed in the path of the delivery mechanism to lock the delivery mechanism in place so as to duplicate the action of a conventional toe-raised brake for emergency stopping. Several ways of incorporating the arresting mechanism will be discussed.

The brake surface of the system of this invention is the element which is driven to the ground by the delivery mechanism. The most basic version of the brake surface is a pad, but other embodiments, including a friction-damped wheel or an eccentric/round braking surface, will be discussed.

The actuator mechanism is used to activate the delivery mechanism. Various versions of the actuator mechanism, with cables or with wireless components, and including a specially designed hand or leg control, will be discussed.

Finally, and of no less importance, a method of fitting the brake system of this invention to in-line skates, including both newly manufactured skates and existing skates, is disclosed. An important condition to achieving the advantages of the brake system of this invention is, of course, that the system must be capable of practical installation in an in-line skate. Indeed, without a practical way either to retrofit existing skates or to fit newly manufactured skates, the objects of this invention would never be realized by skaters. Because of specific characteristics of this invention, a method for fitting the brake system disclosed herein both to existing in-line skates and to newly manufactured skates can be devised, and is disclosed as part of this invention.

For purposes of this summary, the most basic features of the various delivery mechanisms will be pointed out. Further details of the delivery mechanisms, and of the various other components of the brake system, will be provided in the detailed description.

The most basic version of the "carriage" delivery mechanism of this invention includes a carriage that pivots about the rear of a skate so as to bring a brake surface into contact with the ground when the carriage is activated. The carriage is hand-activated so that the skater need not perform any special body movement so as to raise (or lower) the toe of the skate. Accordingly, the angle of the skate relative to the ground remains constant while the brake is applied.

A U-shaped brake carriage may wrap around the heel of a skate, with the heel of the U being oriented to the rear so that a brake pad may be brought into contact with the skating surface behind the skate when the carriage is activated. The open end of the unshaped carriage may face towards the front of the skate, and the closed end may extend outwards behind the heel of the skate.

In one mode (for easy retrofit to existing skates) the brake carriage is pivotally connected to the axle of the rearmost wheel of the skate. A pair of holes from one arm to the opposite point on the other arm of the U is adapted so that the brake carriage may be mounted on the axle of the wheel.

The brake surface may be a brake pad mounted on the brake carriage behind the heel of the skate. Such a brake pad may be contained within the cup of the "U" and secured by a bolt embedded in the brake pad that is attached by a nut to a mounting piece within the carriage. The pad may be further secured to the carriage by a set of complementary nipples and holes disposed in the mounting piece and the brake pad. When the brake is activated, the brake pad will swing down with the brake carriage until the pad hits the ground. When not activated, the brake pad will ride with the brake carriage above the skating surface. The brake pad may be formed of a high density molded material having a high coefficient of friction and high durability.

The arms of the brake carriage act as levers about the pivot point. A first force applied to an arm causes the brake carriage to rotate about the axle of the wheel in a first direction and drives the brake pad against the ground. A second force applied to an arm causes the brake carriage to rotate about the axle in a second direction and pulls the brake pad away from the ground.

A mechanical advantage may be obtained by mounting a variable force mechanism on the delivery mechanism. This can be done by mounting a pulley on the axle of the wheel and threading a cable around the pulley, by mounting a lever and/or cam on the carriage, or otherwise. Likewise, the other components previously referenced (the arresting mechanism, the different kinds of brake surfaces instead of a brake pad, and the actuator mechanism) may be combined. The foregoing summary simply refers to a basic carriage delivery mechanism set in a basic brake system.

In the "rocker arm" embodiment of the delivery mechanism of the brake system, a pivoting rocker arm is used to drive a brake surface to the ground.

In the "plunger" embodiment of the delivery mechanism, there is a plunger housing mounted on a skate and containing a plunger that moves so as to bring the brake surface into contact with the ground when the plunger is activated. When the plunger housing is oriented so that the plunger axis is substantially vertical relative to the ground, a brake surface connected to the plunger will contact the ground as the plunger is lowered. Thus, in a way analogous to the other ground engaging movable brakes of this invention, a first force applied to the plunger lowers it and drives the brake surface against the ground. A second force applied to the plunger lifts it and pulls the brake surface away from the ground.

In the "side rail" embodiment of the delivery mechanism, the braking surface is mounted on a bar or rail carried to the side of skate, and the braking surface is brought into contact with the ground by movement of the bar or rail. For retrofit to existing skates, this embodiment makes use of the axles of two or more wheels.

In the "integrated" embodiment of the delivery mechanism, an existing housing of the type used on several in-line skates currently available is used to hold a ground engaging moveable brake surface. A mechanism is fitted into, and integrated within, the existing housing so as to drive a brake surface against the ground.

The brake system of this invention (whether embodied with a rocker arm, carriage, plunger, side rail, or integrated delivery mechanism) is remotely activated by hand so that the skater need not perform any special body movement so as to raise (or lower) the toe of the skate. Alternatively, the brake system may be actuated by movement of the skater's leg, such as with cuff actuation or other actuation as described hereinafter.

In many embodiments, a cable-and-lever system may be used to provide the first force that drives the brake surface to the ground for stopping, and a spring may be used to provide the second force for holding the brake pad away from the ground for free skating. Easily understood variations on the cable system-include wire, pneumatic, hydraulic, or electromagnetic elements. Likewise, an easily understood variation would be to reverse the push/pull orientation of the first and second forces. In those cases where a cable or wire is used, it becomes important to retain the cable, and this invention includes a housing that can be worn by the skater as a belt.

The belt includes elastic retainers that hold the cables, and also VELCRO-brand hook and loop fasteners. The elastic retainers are intended to help guard against the cables' dragging behind the skater if the cables should be dropped. The VELCRO-brand fasteners are intended to be used with complementary fasteners on the hand-operated levers so that the skater may conveniently affix the hand levers to the belt until needed. The hand lever is designed so as to return to a closed position so that the hand lever, if dropped, will be less likely to catch on posts or other stationary objects.

The skate brake system of this invention may be used on either skate (left or right). It may also be used on both skates. When used on both skates, only one brake will preferably be actuated at a time. When affixed to either skate, the skate brake system of this invention provides an effective surface area for the application of stopping force to the ground which is equal to or greater than that of typical toe-raised brakes, and which is substantially greater than typical wheel-based brakes. When affixed to both skates, the skate brake system of this invention can effectively double, or more than double, the stopping surface area of typical toe-raised brakes, and far exceeds the stopping surface area of the typical wheel-based brake.

In the various embodiments just summarized, a variable force mechanism, including a lever, cam, pulley, and/or worm gears may be used. So also, an arresting mechanism may be provided. The brake surface may be a brake pad, and may also be part of a friction-damped wheel. The delivery mechanism may be affixed to the skate behind the rearmost wheel, or at a point in advance of the rearmost wheel, and may use an axle of the skate or an axis parallel to an axle of the skate. These improvements and refinements are equally adaptable for use with the several of the specific delivery mechanisms.

In one exemplary embodiment, the invention provides a roller skate system having a roller skate and a braking mechanism which is operably attached to the roller skate. The roller skate comprises a frame having a longitudinal axis, a piece of footgear securely attached to the frame, and a plurality of wheels operably attached to the frame in alignment with the longitudinal axis. The braking mechanism is provided with a braking pad that is in alignment with the longitudinal axis. The braking pad is movable between a first position above a skating surface and a second position in contact with the skating surface. An actuator is further provided which moves the braking pad between the first and second positions while the angle of the skate relative to the skating surface remains constant.

In one particular aspect, the actuator comprises a rigid elongate member and a pivot arm. The elongate member is provided with a region for interacting with a user's leg. The actuator is attached to the roller skate by a pivotal connection on the pivot arm, and the actuator is also operably connected to the braking mechanism so that movement of the user's leg moves the elongate member about the pivotal connection to move the braking pad. In one embodiment, the actuator is operably attached to the braking mechanism by a pair of cables. The cables are attached on opposite sides of the pivotal connection so that pivoting of the pivot arm in one direction causes one of the cables to move the braking pad to the second position while pivoting of the pivot arm in an opposite direction causes the other cable to move the braking pad to the first position. In one particular aspect, a biasing member is provided to bias the region for interacting with the user's leg against the user's leg so that the braking pad is normally held in the first position above the skating surface. The biasing member may comprise, for example, the interior lining of the boot, a pivoting cuff of the boot, a spring, and the like.

In another embodiment, the piece of footgear comprises a body and a cuff which is pivotally attached to the body. The actuator comprises a pair of cables that are attached on opposite sides of the pivotal connection of the cuff. In this manner, pivoting of the cuff in one direction causes one of the cables to move the braking pad to the second position while pivoting of the cuff in another direction causes the other cable to move the braking pad to the first position.

In another particular aspect, the braking mechanism further comprises a braking element or housing which holds or houses the braking pad, and the elongate member is directly attached to the braking element. In yet another aspect, the braking pad is removably attached to the housing. Preferably, the housing and the braking pad include matable tracks such that the braking pad and housing may be easily separated by sliding them apart. The braking pad may optionally be provided with a tab which interlocks with an aperture in the housing to secure the braking pad to the housing. In this manner, the braking pad may easily be removed from the housing by depressing the tab and sliding the braking pad from the housing. Such a feature allows the braking pad to easily be replaced, such as when replacing a worn pad or providing a pad with different material. Preferably, the braking pad will be constructed of a rubber or plastic having a durometer in the range from about 50 to about 100 on the Shore A scale.

In one particularly preferable aspect, the braking mechanism includes a slidable member which is attached to the braking pad, and the roller skate includes a fixed member. The slidable member is slidably engaged with the fixed member such that the slidable member may slide to move the braking pad between the first and second positions when actuated by the actuator. The fixed member may be provided with a variety of geometries, such as a spherical element which slides in a groove in the slidable member. Alternatively, the fixed member may comprise a rail which slides within a groove in the slidable member. In yet another aspect, the braking member may comprise a carriage which is attached to the braking pad, with the carriage being pivotally attached to the roller skate.

The invention provides a further exemplary embodiment of a roller skate system comprising a roller skate and a braking mechanism. The roller skate includes a frame, a piece of footgear securely attached to the frame, a plurality of wheels operably attached to the frame and a pivotal portion which is pivotable about a pivot point. In this manner, movement of the user's legs while within the footgear causes the pivotable portion to pivot about the pivot point. The braking mechanism comprises a braking pad which is operably attached to the roller skate. The braking pad is movable between a first position above a skating surface and second position in contact with the skating surface. A pair of cables are provided to move the braking pad between the first and second positions. The cables are operably attached to the roller skate and the braking mechanism, with the cables being connected to the roller skate on opposite sides of the pivot point. In this manner, pivoting of the pivotable portion in one direction causes one of the cables to move the braking pad to the second position while pivoting of the pivotable portion in another direction causes the other cable to move the braking pad to the first position.

In an exemplary aspect, the piece of footgear comprises both a body and a cuff. The cuff is pivotally attached to the body at the pivot point, and the cables are attached to the cuff. In this way, pivoting of the cuff with the user's leg will move the braking pad between the first and second positions.

In another exemplary aspect, the pivotable portion comprises a rigid elongate member having a region for interacting with the user's leg and a pivot arm. The pivot arm is pivotally attached to the piece of footgear at the pivot point. The cables are further attached to the pivot arm so that movement of the user's leg moves the elongate member about the pivotal connection to move the braking pad.

The invention further provides a braking system for a roller skate. The braking system includes a housing and a braking pad which is removably attached to the housing. The housing and the braking pad include matable tracks such that the braking pad and housing may be separated by sliding them apart. Preferably, the braking pad includes a tab which interlocks with an aperture in the housing to secure the braking pad to the housing. In one aspect, the braking pad is constructed of a rubber or plastic having a durometer in the range from about 50 to about 100 on the Shore A scale. In this manner, braking pads having different durometers may be interchanged by simply sliding one braking pad from the housing and interchanging it with another braking pad having different durometer.

The invention further provides an exemplary method for slowing or stopping a roller skate. According to the method, the roller skate is provided with a frame, a piece of footgear securely attached to the frame, and a plurality of wheels operably attached to the frame. Further provided is a braking mechanism which is operably attached to the roller skate. The braking mechanism has a braking pad which is movable between a first position above a skating surface and a second position in contact with the skating surface. A rigid elongate member is further provided having a region for interacting with a user's leg and a pivot arm. The pivot arm is pivotally attached to the roller skate at a pivot point, and the elongate member is operably attached to the braking mechanism. The skate is slowed or stopped by moving the user's legs while within the piece of footgear in a first direction to pivot the pivot arm about the pivot point and to move the braking pad from the first position to the second position.

In one exemplary aspect of the method, the elongate member is operably attached to the braking pad by a pair of cables. The cables are on opposite sides of the pivotal connection so that when the user's leg is moved within the piece of footgear one of the cables will move the braking pad from the first position to the second position. In another aspect, the braking mechanism further includes a braking element which holds the braking pad, and the elongate member is directly attached to the braking element. With this configuration, the user's leg is moved while within the piece of footgear to swing the elongate member about the pivot point the move the braking pad from the first position to the second position.

In summary, the brake system of this invention includes a ground engaging movable brake. The brake system is remotely hand-activated or leg actuated, uses the skating surface (rather than a wheel of the skate) for generating stopping force while the angle of the skate relative to the ground remains constant, has a large effective area in contact with the skating surface, can be fitted to both skates, allows for an independent selection of the material in contact with the braking surface, incorporates an emergency brake, can be readily installed in new or used skates, and conveniently retains all cables and hand levers which are a part of the system. These, and other advantages, of the brake system of this invention will become apparent in the remainder of this disclosure.

DETAILED DESCRIPTION OF THE INVENTION

The brake system of this invention is characterized as being ground-engaging and movable so that the brake system engages the ground while a delivery mechanism of the brake system moves relative to the skate. The result is to drive a braking surface to the ground while the angle of the skate relative to the ground remains constant. Accordingly, the brake system of this invention brings a brake surface into contact with the ground by moving the brake surface independently of the angle of the skate relative to the ground.

In summary, the ground engaging movable brake system of this invention includes at least some of the following basic component elements: (1) a delivery mechanism for driving a brake surface to the ground; (2) a variable force mechanism for providing an increased mechanical advantage to the delivery mechanism or otherwise enhancing the performance of the system; (3) an arresting mechanism to provide an emergency back-up in the event that the delivery mechanism should fail; (4) a brake surface driven to the ground by the delivery mechanism; and (5) an actuator mechanism for activating the delivery mechanism. As will be seen, each of the various component elements will be described in several embodiments, and complete brake systems combining certain of the elements will be described in such a way that other combinations of the elements will become clear to those skilled in the art.

Each of the foregoing component elements will be discussed in turn, and in the context of a complete brake system.

BASIC DELIVERY MECHANISMS

The delivery mechanism of this invention is the device that drives the brake surface to the ground. Five embodiments of the delivery mechanism will be referred to as: (a) a rocker arm, (b) a carriage, (c) a plunger, (d) a side rail, and (e) an integrated unit. The following discussion will address each of these five delivery mechanisms. Other delivery mechanisms will be described later.

Basic Rocker Arm Delivery Mechanism

Figure 1:
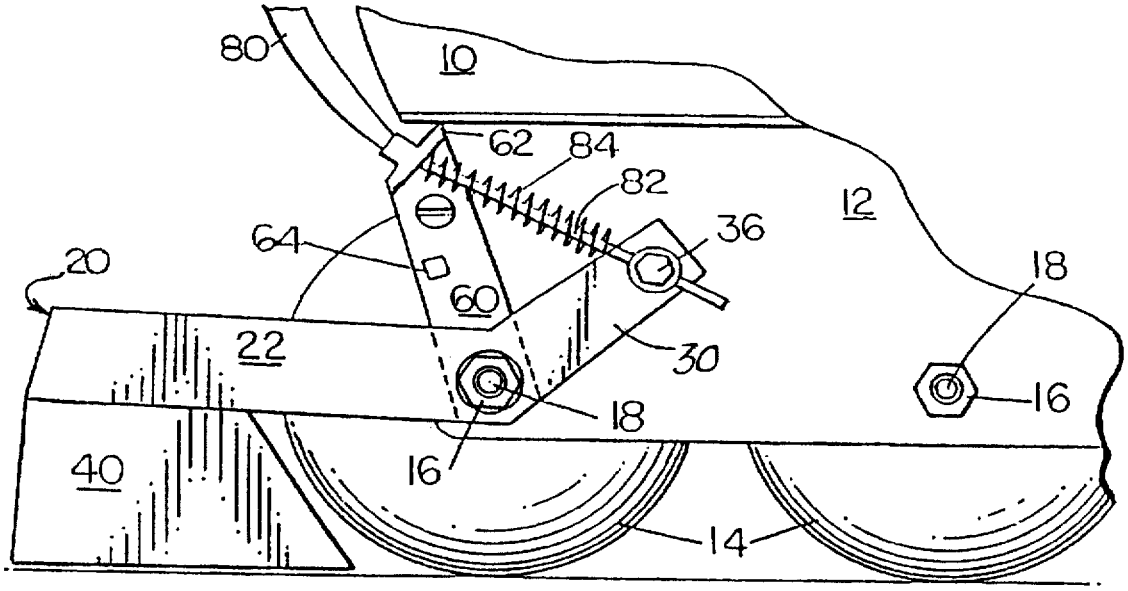
FIG. 1 is a side elevational view of a rocker arm embodiment of the delivery mechanism of the brake system of this invention.

With reference to FIG. 1, it can be seen in overview that a basic rocker arm delivery mechanism of the brake system of this invention includes: a rocker arm 22 held within a frame 20, a brake pad 40, an actuator support arm 60, and an actuator assembly 80. In this embodiment, a lever end 30 of the rocker arm 22 serves as the variable force mechanism, and an arm 64 on the actuator support arm 60 serves as the arresting mechanism. Each of these elements will be discussed individually, and with reference to FIGS. 2–5 before returning to FIG. 1 for a discussion of the elements in combination.

Figure 2:
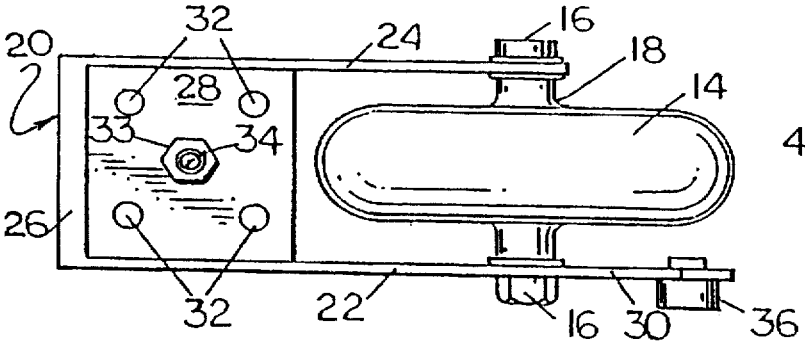
FIG. 2 is a top plan view of the rocker arm embodiment of FIG. 1.

Referring to FIG. 2, it can be seen that the rocker arm 22 of this invention is carried in a "U" shaped frame 20 having, in addition to the rocker arm, an opposing arm 24, a back frame member 26, and a brake mounting piece 28. The rocker arm 22 is longer than the opposing arm 24, and it may be seen that an extending segment 30 of the rocker arm 22 extends the rocker arm beyond the axle 18 of the wheel 14 of a skate.

The frame 20 is set behind the skate. In this embodiment, the frame is oriented so that it may wrap around the back of the skate. The frame 20 is pivotally attached to the axle 18 of a wheel 14 of a skate, and held in place by the axle nuts 16. A swiveling cable anchor nut 36 is affixed to the end of the extending segment 30 of rocker arm 22.

The brake mounting piece 28 of the frame 20 has four holes 32 which serve to retain the brake pad (not shown in FIG. 2). A nut 33 is shown above a hole 34, and serves to affix the brake pad (not shown).

Figure 3:
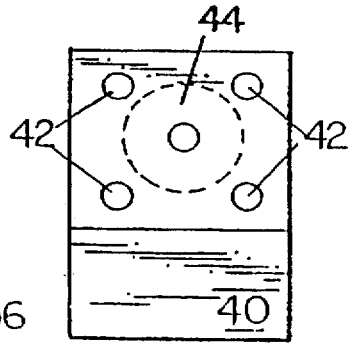
FIG. 3 is a top plan view of a brake pad used in the rocker arm embodiment of FIG. 1.
Figure 4:
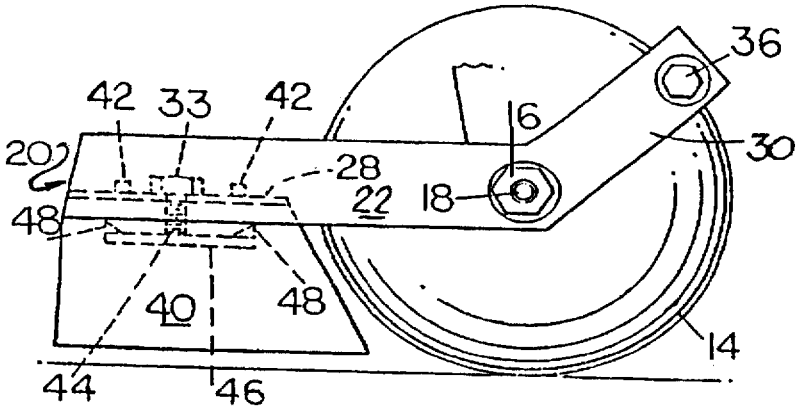
FIG. 4 is a side elevational view of the rocker arm embodiment of FIG. 1, showing the brake pad mounted therein.

With reference both to FIGS. 3 and 4, it can be seen that the brake pad 40 has four nipples 42 protruding from its top surface, and has an embedded bolt 44. Looking at FIG. 4, it can be understood that the brake pad 40 fits securely into the frame 20 within the cup formed at the base of the "U". It can be seen that the embedded bolt 44 of the brake pad 40 passes through the hole 34 (not separately numbered in FIG. 4) of the brake mounting piece 28 and is attached to the mounting piece 28 by bolt 33. The nipples 42 of the brake pad 40 pass through the holes 32 (not separately numbered in FIG. 4) of the brake mounting piece 28 and further secure the brake pad 40 in place.

In FIG. 4, it may also be seen that the embedded bolt 44 of the brake pad has a head 46 having flanges 48. The flanges 48 serve to secure the bolt 44 within the brake pad 40.

Figure 5:
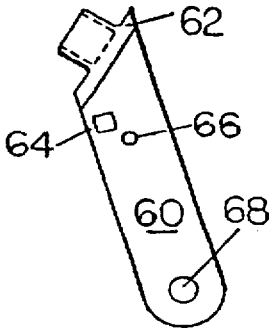
FIG. 5 is a side elevational view of the actuator support arm of the rocker arm embodiment of FIG. 1.

Referring to FIG. 5, the actuator support arm 60 has an actuator housing 62, an arresting arm 64, a first hole 66 and a second hole 68. The actuator housing 62 of the support arm 60 is designed to carry the actuator (not shown) that will active a rocker arm of the brake carriage 20. In this embodiment, the actuator housing 62 is set for carrying a cable linkage.

The arresting arm 64 of the actuator support arm 60 is designed to be an emergency brake, for use if the actuator should fail. The arresting arm 64 protrudes outward from the actuator support arm 60. The first hole 66 and second hole 68 are designed for attaching the actuator support arm 60 to the skate. In this embodiment, the actuator support arm 60 is slipped over the axle of the skate (not shown in FIG. 5) at the second hole 68, and a self-tapping screw (not shown)

is driven through the first hole 66 and into the skate to hold the actuator support arm 60 in place.

Returning to FIG. 1, it can now be seen that the frame 20 is pivotally attached behind the heel of an in-line skate boot 10. A typical in-line skate, as shown in FIG. 1, includes a skate boot 10 having a wheel housing 12 in which several wheels 14 are mounted. Each wheel 14 is affixed by a nut 16 to an axle 18. The brake frame 20 pivots about the axle 18 of the rearmost wheel 14.

The frame 20 carries the brake pad 40, and the brakeframe is slipped onto the axle 18 of the wheel 14 over the actuator support arm 60. The frame 20 is operatively connected to the actuator assembly 80. In this embodiment, the actuator assembly includes a cable 82 having a linkage carried in the actuator housing 62 of the actuator support arm 60.

The rocker arm 22 is connected to cable 82 of the actuator assembly 80. The connection to cable 82 is by way of a swiveling cable anchor nut 36. It should be noted that rocker arm 22 includes extending segment 30 in which the swiveling cable anchor nut 36 is mounted. Segment 30 is angled upwards from the horizontal so as to approach the cable housing stop 62 of the actuator support arm 60, making the cable pull on the rocker arm 22 more efficient.

It can be understood that, when the actuator assembly 80 is engaged so as to pull the cable 82 towards the cable housing stop 62, the resultant force will pull segment 30 of rocker arm 22 towards the cable housing stop 62 of the actuator support arm 60. This, in turn, will cause the brake frame assembly 20 to rotate in a counter-clockwise direction about the pivot axle 18 of the rearmost wheel 14. This rotation will urge the brake pad 40 towards the ground where it will engage the skating surface to stop the skate.

A spring 84 is disposed between the cable anchor nut 36 held in segment 30 of rocker arm 22, and the cable housing stop 62 of the actuator support arm 60. Thus, when the cable 82 is not engaged, the spring tension will push segment 30 of rocker arm 22 away from the cable housing stop 62 of the actuator support arm 60. This, in turn, will cause the brake frame assembly 20 to rotate in a clockwise direction about the pivot axle 18 of the rearmost wheel 14. This rotation will urge the brake pad 40 away from the ground where it will ride until activated by the actuator assembly 80.

The arresting arm 64 of the actuator support arm 60 can now be understood to operate as an emergency brake. In the event that some component of the actuator assembly 80 should fail, the system of this invention uses the arresting arm 64 to simulate the working of a traditional toe-raised brake. It can be seen that the arresting arm 64 extends outward from the actuator support arm 60.

In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although the rocker arm 22 of the brake frame 20 will pivot, the arresting arm 64 will limit the arcuate range of rotation, and will lock the rocker arm in place at the limit of rotation. Locked into place, the rocker arm 22 holds the brake pad 40 against the skating surface so that the brake pad will drag against the ground and bring the skater to a stop.

Materials and dimensions suitable for producing this embodiment of the brake system of this invention include these:

The brake frame 20, as shown in FIG. 2, may be of cast steel, aluminum, or a high density polymer; the back frame member 26 is about 2.0 inches in length; the rocker arm 22 is about 5.0 inches in length (with the extending segment 30 being about 2.0 inches in length); and the opposing arm 24 is about 3.0 inches in length. The angle formed by the extending segment 30 relative to horizontal is in the range of 15' to 45'.

The brake pad 40 may be molded polyurethane and dimensioned so that the bottom surface is about 1.5 inches by about 2.25 inches so as to provide a stopping surface of about 3.375 square inches. The embedded bolt 44 may be 0.25 inch-20 having 1.0 inch length with a 31/32 inch bolt head.

The actuator assembly 80 may include a cable housing having an outer diameter of about 5.0 mm, and an inner diameter of about 2.0 mm. The cable housing may be of coiled steel with vinyl covering and a TEFLON brand liner. The cable 82 has a diameter of slightly less than 2.0 mm and may be made of wound steel.

Alternate Rocker Arms

Figure 16A:
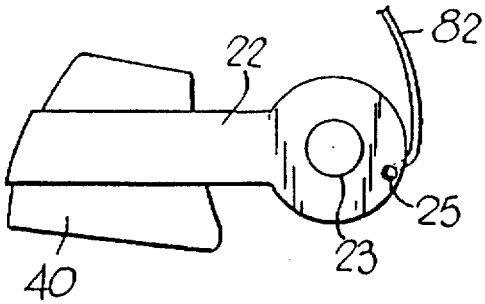
FIGS. 16A–16D are side elevational views.

Other forms of a rocker arm are shown in FIGS. 16A 16 E. For ease of reference, each rocker arm, and the common elements of the various versions will be designated with identical numerals.

In FIG. 16A, the rocker arm 22 holds brake pad 40 at one end of the rocker arm. The other end of the rocker arm is circular in shape, having a pivot point 23 and a pull point 25. A cable 82 is attached to pull point 25. When the cable is connected to an actuator assembly, a pull on cable 82 will cause rocker arm 22 to rotate about the pivot point, driving the brake pad 40 to the ground. It will be seen that the circular shape of the rocker arm at the end where pull point 25 is located can act as a cam so as to give a mechanical advantage to the mechanism if the cable 82 is set so as to pull across the circumference of the circle.

Figure 16B:
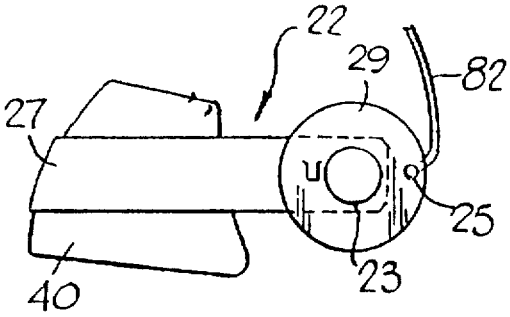
Figure 16C:
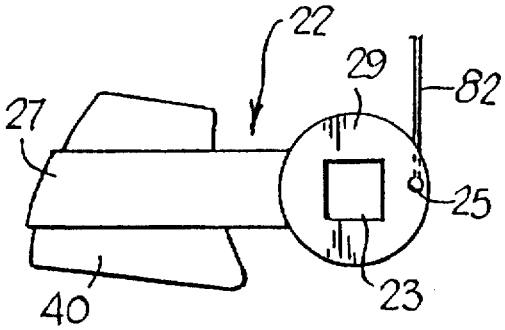

The rocker arm of FIG. 16A is an integrally formed piece. It is possible, and in some circumstances it may be preferable, to use two pieces to form a rocker arm. In FIGS. 16B and 16C, the rocker arm 22 is in two pieces. In both FIGS. 16B and 16C, rocker arm 22 has a first end 27 and a second end 29.

In the rocker arm of FIG. 16B, the first end 27 locks into second end 29 by way of reciprocally shaped groves in the two pieces.

In the rocker arm of FIG. 16C, the first end 27 and the second end are both locked to a shaped axle segment (as illustrated, there is a square-shaped axle segment at pivot point 23, and each of the first end and second end have a square shaped opening to lock on the axle segment).

Once the two pieces of the rocker arm are locked in place, the structures of FIGS. 16B and 16C function just as the structure of FIG. 16A, it being understood that both of these structures have a pivot point 23 and a pull point 25 in the circular second end 29 of the rocker arm 22. A cable 82 attached to the pull point 25 can rotate the rocker arm about the pivot point, driving the brake pad 40 to the ground.

Figure 16D:
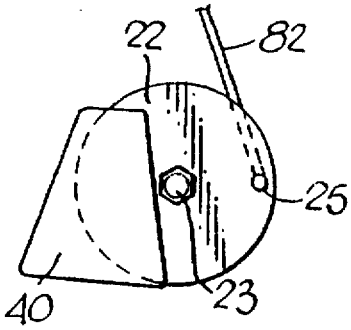

FIG. 16D illustrates a rocker arm that is divorced from any frame (frame 20, for example, in FIG. 1). It should already be clear from an understanding of the basic rocker arm that the frame is not necessary, rather it is simply necessary to have a rocker arm carrying a brake about a pivot point. Particularly for expert skaters, who do not want the encumbrance of a brake frame carried behind the skate, a more compact rocker arm is a preferred approach.

With reference to FIG. 16D, it may be understood that a rocker arm embodiment of this invention may be a simple rocker arm 22 having a pivot point 23, a pull point 25, and carrying a brake pad 40. A cable 82 is attached to pull point 25. when the cable is connected to an actuator assembly, a pull on cable 82 will cause rocker arm 22 to rotate about the pivot point, driving the brake pad 40 to the ground. It will be seen that the circular shape of the rocker arm at the end where pull point 25 is located can act as a cam so as to give a mechanical advantage to the mechanism if the cable 82 is set so as to pull across the circumference of the circle.

The rocker arm 22 of FIG. 16D has a shaped opening at the pivot point 23 so that the rocker arm may be locked to an axle having a reciprocally shaped segment. As illustrated in FIG. 16D, the shaped opening is hexagonal.

Figure 16E:
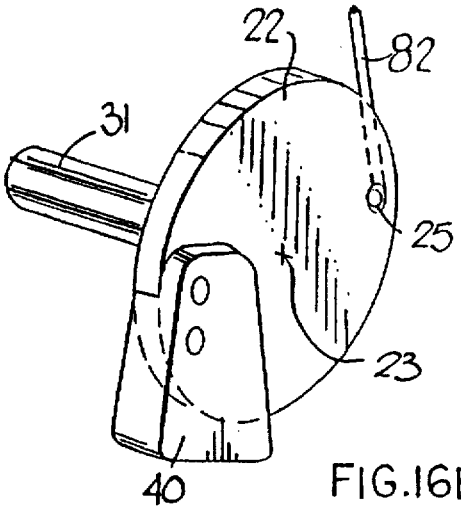
FIG. 16E is a perspective view, of alternative rocker arms for use in the system of this invention.

FIG. 16E illustrates a simple rocker arm 22 much like the rocker arm of FIG. 16D.

The rocker arm of FIG. 16E has a pivot point 23, a pull point 25, and carrying a brake pad 40. A cable 82 is attached to pull point 25. when the cable is connected to an actuator assembly, a pull on cable 82 will cause rocker arm 22 to rotate about the pivot point, driving the brake pad 40 to the ground. It will be seen that the circular shape of the rocker arm at the end where pull point 25 is located can act as a cam so as to give a mechanical advantage to the mechanism if the cable 82 is set so as to pull across the circumference of the circle.

The rocker arm 22 of FIG. 16E has an axle 31 integrally formed therein, or fixedly connected thereto. It does not need to lock into the axle as was the case with the embodiment of FIG. 16D.

The rocker arms 22 of FIGS. 16D and 16E offer some significant advantages to the more advanced skater, and may be desirable for all skating levels. These are relatively small units, and they may be mounted (with appropriate spacers, well known in the art) directly on the wheel axle of a skate. They may also be mounted to the frame on an axle parallel to the wheel axles, but apart from the wheels.

Further, these rocker arms may be mounted in sets (with yoked cable pulls, well known in the art) so that a single skate might have rocker arms in tandem at one, two, three or more wheels. As illustrated, these rocker arms carry a brake pad 40 which is wider than the rocker arms 22, primarily to permit a relatively large area on the brake surface which contacts the ground. But, when two, three or more rocker arms are used in tandem on the skate, each one can carry a thinner brake pad 40 and still provide adequate brake surface in contact with the ground.

It is possible, therefore, to design a very thin, small, and unobtrusive brake system using these rocker arms. Such a small brake system would not interfere significantly with the maneuvering of an expert skater (that is, there would be little or nothing that might drag on the ground in extreme canting or other extreme positioning of the skate), but would still provide the benefits of this invention to such a skater.

The rocker arms of FIGS. 16D and 16E both carry separate brake pads 40. It should be understood that the brake surface may simply be an end of the rocker arm itself.

Such a surface may be on an elongated end of a rocker arm of the type shown in FIGS. 16A–16C (this is one reason why the two-piece rocker arm structures of 16B and 16C may be particularly advantageous—in those embodiments, the end 27 of the rocker arm which would be driven to the ground and would therefore act as the braking surface, can be formed of a material separate from the material of the other end 29, and can be replaced separately from the other end 29).

Such a surface may also be an elliptical "bulge" on a generally circular-shaped rocker arm of the type shown in FIGS. 16D and 16E. Such an elliptical bulge is described in some detail later in this disclosure with reference to the "integrated" delivery mechanisms (reference FIGS. 21, 22 and 29), and that explanation is equally suitable to describe an elliptical bulge that could be formed directly on the rocker arms of FIGS. 16D and 16E so as to provide a brake surface while eliminating the need for a separate brake pad 40.

Figure 23:
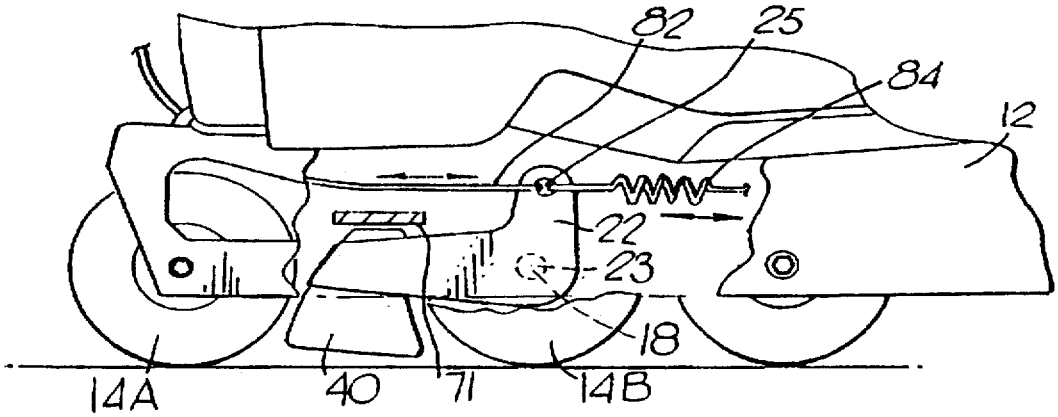
FIG. 23 is a partially cut away side elevational view of a rocker arm delivery mechanism, showing the rocker arm attached at an axle of the skate between the fourth wheel (rearmost wheel) and the third wheel of a skate.
Figure 24:
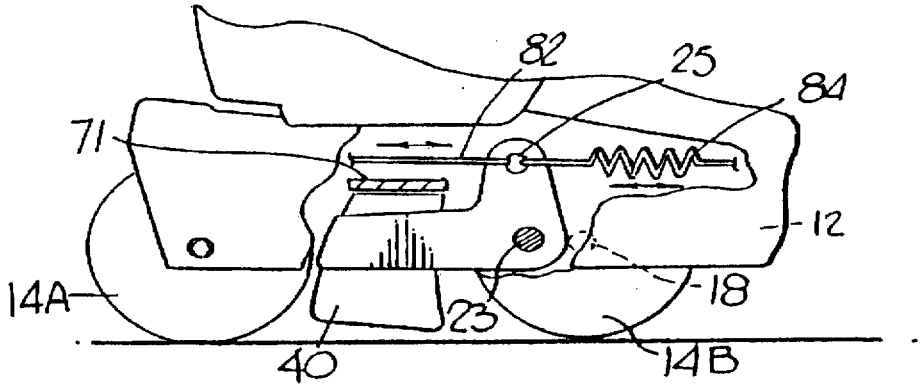
FIG. 24 is a partially cut away side elevational view of a rocker arm delivery mechanism, showing the rocker arm attached at an axis parallel to the axle of the skate between the fourth wheel (rearmost wheel) and the third wheel of a skate.

Yet another rocker arm delivery arrangement is shown in FIGS. 23 and 24. These embodiments show that the rocker arm need not be disposed behind the rearmost wheel of the skate.

In FIG. 23, a rocker arm 22 has a pivot point 23 and a pull point 25. A brake pad 40 is carried by the rocker arm, and the rocker arm is set on axle 18 of wheel 14B of a skate. Cable 82 is attached to pull point 25 of rocker arm 22, and spring 84 is attached to pull point 25 so that the rocker arm will rotate about pivot point 23 when the cable is pulled so as to drive the brake pad 40 to the ground; spring 84 serves to hold the brake pad above the skating surface when the cable 82 is not pulled (stop 71 within the skate frame 12 prevents the rocker arm from being pulled too far by the spring).

The rocker arm of FIG. 23 is disposed behind wheel 14B, which is not the rearmost wheel of the skate (as illustrated, wheel 14A is the rearmost wheel). An advanced skater may appreciate not having a brake apparatus overhanging the rear of the skate, and may prefer the placement of the brake as shown in FIG. 23.

FIG. 24 is substantially like the rocker arm of FIG. 23. The similarities will not be discussed, but the difference is that pivot point 23 is not limited to placement at the axle 18 of the wheel 14B. Instead, the pivot point is set in frame 12. This provides additional freedom to the brake designer because to permits the axis of the rocker arm to be lower or higher than the axle of the wheel for adjusting the brake force.

The foregoing description of the rocker arm delivery mechanism of this invention is to be understood in light of the further description of various refinements and variations to the system of this invention which follows, as well as in light of adaptations readily apparent to those skilled in the art. In particular, and among other variations, it will be understood that the rocker arm may be shaped as an eccentric/round figure, does not require a supporting frame, need not be placed at an axle of the skate, and need not be placed at or near the axle of the rearmost wheel.

Basic Carriage Delivery Mechanism

Figure 6:
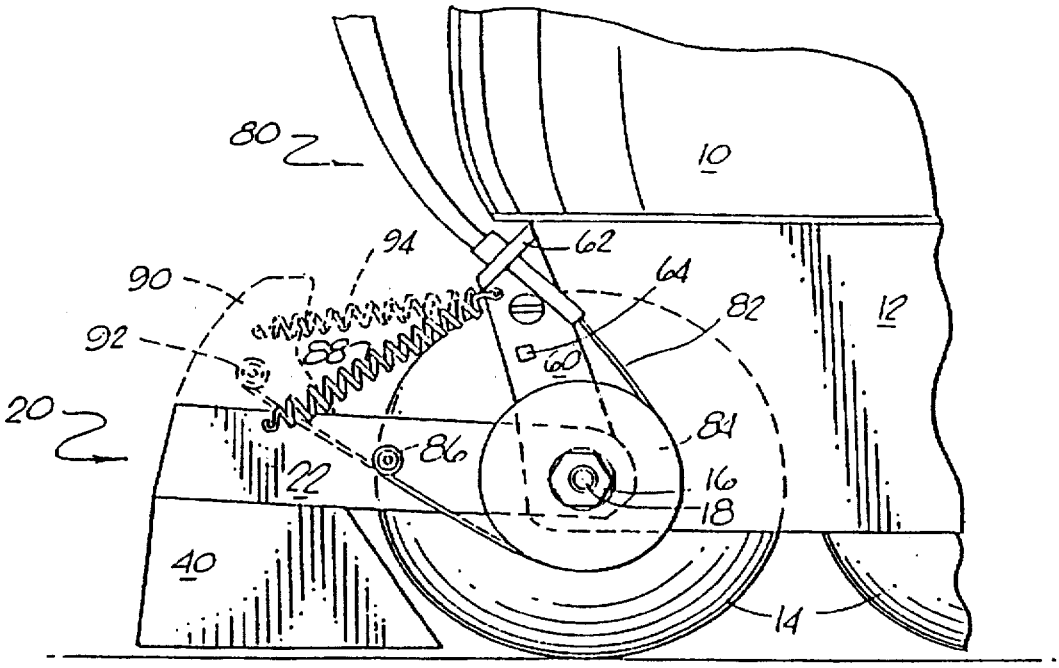
FIG. 6 is a side elevational view of a carriage embodiment of the delivery mechanism of the brake system of this invention.

With reference to FIG. 6, it can be seen in overview that a basic carriage delivery mechanism of the brake system of this invention includes a brake carriage 20, a brake pad 40, an actuator support arm 60, and an actuator assembly 80 (for ease of reference, structures which are common to the carriage delivery mechanism and the rocker arm mechanism already discussed will be designated with identical numerals, but with frame 20 of the rocker arm now being referred to as carriage 20, and with rocker arm 22 now being referred to as a first arm 22). In this embodiment, a pulley 84 serves as the variable force mechanism, and an arm 64 on the actuator support arm 60 serves as the arresting mechanism. Each of these elements will be discussed individually, and with reference to FIGS. 7–9 before returning to FIG. 6 for a discussion of the elements in combination.

Figure 7:
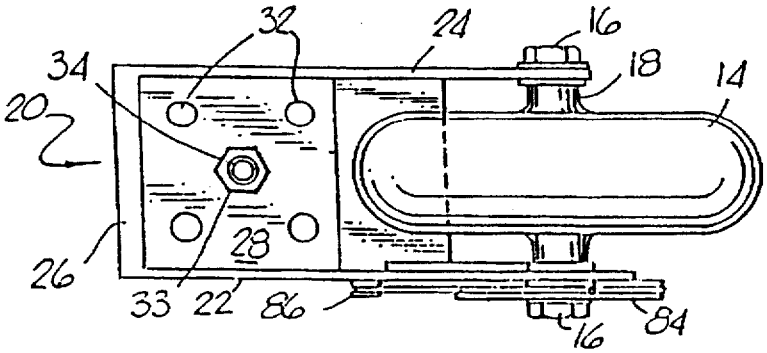
FIG. 7 is a top plan view of the carriage embodiment of FIG. 6.

Referring to FIG. 7, it can be seen that the brake carriage 20 of this invention is a "U" shaped frame having a first arm 22, a second arm 24, a back frame member 26, and a brake mounting piece 28.

It can be seen that the brake carriage 20 is set behind the skate. In this embodiment, the carriage 20 is oriented so that it may wrap around the back of the skate. The brake carriage 20 is pivotally attached to the axle 18 of a wheel 14 of a skate, and held in place by the axle nuts 16. A pulley 84 is mounted on axle 18, and a retaining pin 86 is mounted on carriage arm 22.

The brake mounting piece 28 of the brake carriage 20 has four holes 32 which serve to retain the brake pad (not shown in FIG. 7). A nut 33 is shown above a hole 34, and serves to affix the brake pad (not shown).

Figure 8:
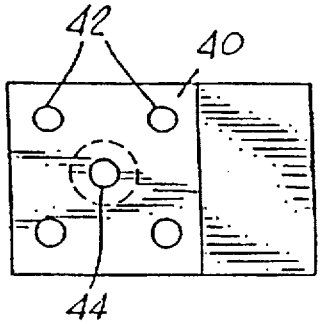
FIG. 8 is a top plan view of a brake pad used in the carriage embodiment of FIG. 6.
Figure 9:
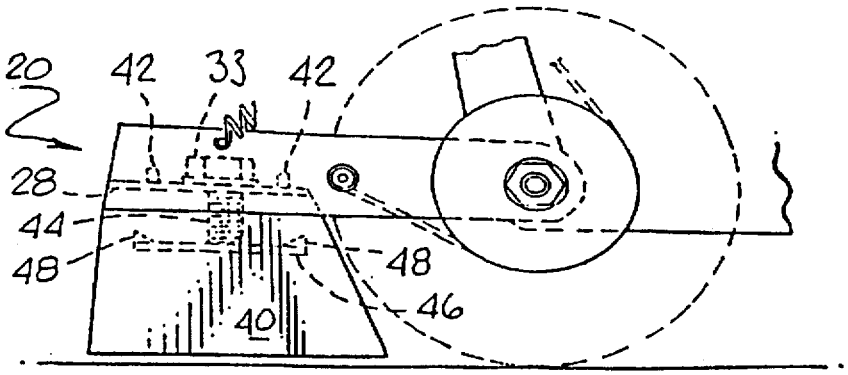
FIG. 9 is a side elevational view of the carriage embodiment of FIG. 6, showing the brake pad mounted therein.

With reference to FIG. 8, it can be seen that the brake pad 40 has four nipples 42 protruding from its top surface, and has an embedded bolt 44. Looking at FIG. 9, it can be understood that the brake pad 40 fits securely into the brake carriage 20 within the cup formed at the base of the "U." It can be seen that the embedded bolt 44 of the brake pad 40 passes through the hole 34 (not separately numbered in FIG. 4) of the brake mounting piece 28 and is attached to the mounting piece 28 by bolt 33. The nipples 42 of the brake pad 40 pass through the holes 32 (not separately numbered in FIG. 9) of the brake mounting piece 28 and further secure the brake pad 40 in place. In FIG. 9, it may also be seen that the embedded bolt 44 of the brake pad has a head 46 having flanges 48. The flanges 48 serve to secure the bolt 44 within the brake pad 40.

Returning to FIG. 6, it can now be seen that the brake carriage 20 is pivotally attached behind the heel of an in-line skate boot 10. A typical in-line skate, as shown in FIG. 6, includes a skate boot 10 having a wheel housing 12 in which several wheels 14 are mounted. Each wheel 14 is affixed by a nut 16 to an axle 18. The brake carriage 20 pivots about the axle 18 of the rearmost wheel 14.

The brake carriage 20 carries the brake pad 40, and the brake carriage 20 is slipped onto the axle 18 of the wheel 14 over the actuator support arm 60. The brake carriage 20 is operatively connected to the actuator assembly 80. In this embodiment, the actuator assembly includes a cable 82 having a linkage carried in an actuator housing 62 of the actuator support arm 60, and a pulley 84 mounted on the axle 18.

Arm 22 of the brake carriage 20 is connected to cable 82 of the actuator assembly 80 at retaining pin 86. Retaining pin 86 is located along the arm as shown. Cable 82 runs from the retaining pin, around pulley 84, and to the linkage carried in actuator housing 62.

It can be understood that, when the actuator assembly 80 is engaged so as to pull the cable 82 towards the actuator housing 62, the resultant force will pull the carriage arm 22 towards the periphery of pulley 84. This, in turn, will cause the brake carriage assembly 20 to rotate in a counter-clockwise direction about the pivot axle 18 of the rearmost wheel 14. This rotation will urge the brake pad 40 towards the ground where it will engage the skating surface to stop the skate.

A tension spring 88 is attached, at one end, to arm 22 of the brake carriage and, at the other end, near actuator housing 62 of the actuator support arm 60. Thus, when the cable 82 is not engaged, the spring tension will pull carriage arm 22 towards actuator housing 62. This, in turn, will cause the brake carriage assembly 20 to rotate in a clockwise direction about the pivot axle 18 of the rearmost wheel 14. This rotation will urge the brake pad 40 away from the ground where it will ride until activated by the actuator assembly 80.

It should be readily understood that the responsiveness of the brake system is influenced by the location of retaining point 86 on the arm in relation to pivot axle 18, which is the pivot point about which the arm rotates. If desired, the responsiveness of the brake system may be further influenced by fixing a retaining pin even further away from pivot axle 18. As will be described below, one way to do so is by using a separate mounting assembly to extend the retaining pin beyond arm 22.

Shown in phantom in FIG. 6 is a mounting assembly 90 set on top of carriage 20. It can be understood that retaining pin 86 could be removed and that cable 82 could be extended so as to reach the mounting assembly. with reference to the phantomed structure shown in FIG. 6, it may be seen that the cable could be secured to mounting assembly 90 at a retaining pin 92, and a tension spring 94 could be set between the mounting assembly 90 and actuator support arm 60. By adjusting the location of the retaining pin in relation to the axis of rotation 18, including placement of the retaining pin above the brake carriage, the retaining pin is extended beyond arm 22 and the responsiveness of the brake system may be tuned as desired.

The arresting arm 64 of the actuator support arm 60 can now be understood to operate as an emergency brake. In the event that some component of the actuator assembly 80 should fail, the system of this invention uses the arresting arm 64 to simulate the working of a traditional toe-raised brake. It can be seen that the arresting arm 64 extends outward from the actuator support arm 60. In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although carriage arm 22 of the brake carriage 20 will pivot, the arresting arm 64 will limit the arcuate range of rotation, and will lock the rocker arm in place at the limit of rotation. Locked into place, the rocker arm 22 holds the brake pad 40 against the skating surface so that the brake pad will drag against the ground and bring the skater to a stop.

Finally, although the brake system as shown discloses an actuator assembly that includes a pulley 84 to obtain a mechanical advantage, it should be understood that the brake system of this invention may be operated with any number of well known equivalent structures, all serving to transmit force to carriage 20 so as to rotate the carriage about a pivot axis.

Materials and dimensions suitable for producing this embodiment of the brake system of this invention include these:

The brake carriage 20, as shown in FIG. 7, may be of cast steel, aluminum, or a high density polymer; the back frame member 26 is about 2.0 inches in length; carriage arms 22 and 24 are about 3.0 inches in length.

The brake pad 40 may be molded polyurethane, and dimensioned so that the bottom surface is about 1.5 inches by about 2.25 inches so as to provide a stopping surface of about 3.375 square inches. The embedded bolt 44 may be 0.25 inch-20 having 1.0 inch length with a 31/32 inch bolt head.

The actuator assembly 80 may include a cable housing having an outer diameter of about 5.0 mm, and an inner diameter of about 2.0 mm. The cable housing may be of coiled steel with vinyl covering and a TEFLON brand liner. The cable 82 has a diameter of slightly less than 2.0 mm and may be made of wound steel.

An Alternate Carriage Delivery Mechanism

Figure 14:
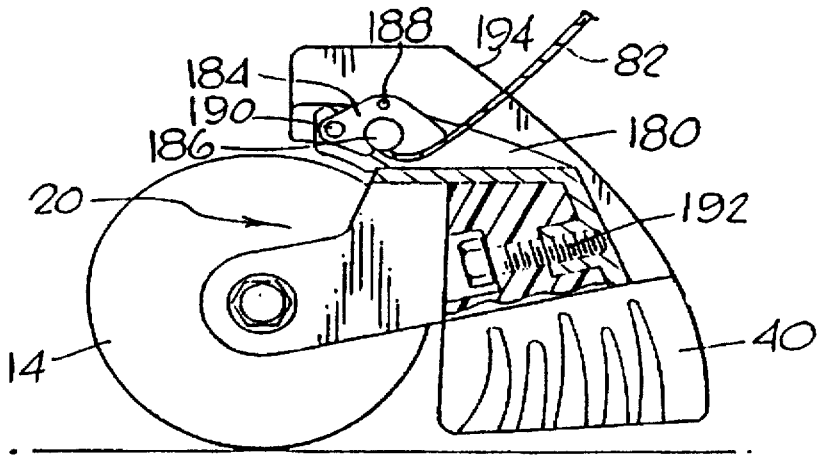
FIG. 14 is a side elevational view of a carriage embodiment of the delivery mechanism of the brake system of this invention, showing a cam and lever.
Figure 15:
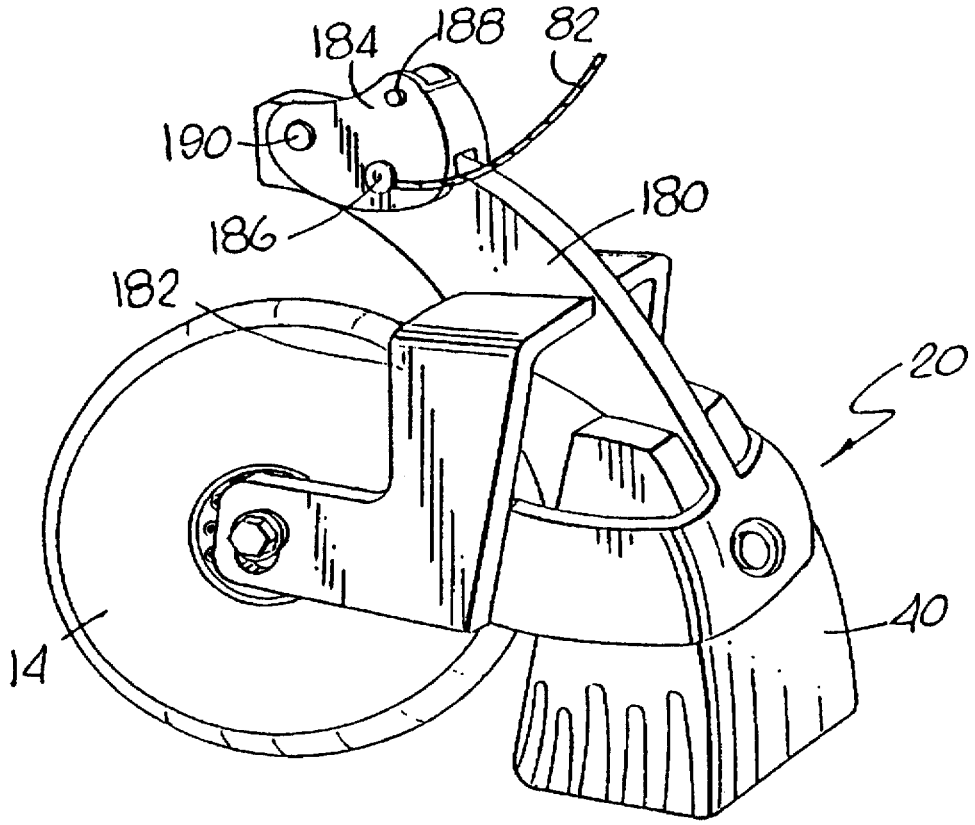
FIG. 15 is a perspective view of the carriage embodiment of FIG. 14.

Another embodiment of the basic carriage delivery mechanism just discussed in connection with FIGS. 6–9 is shown in FIGS. 14 and 15. This alternate embodiment is similar in general operation to the basic embodiment, but it incorporates a variable force mechanism having a lever arm and cam arrangement. In the discussion that follows, it will be assumed that the first embodiment (FIGS. 6–9) of the carriage is well understood, and only the differences present in the alternate embodiment of FIGS. 14 and 15 will now be emphasized.

With reference to FIG. 15, it can be seen that a lever arm 180 is connected to the back of brake carriage 20 so that the arm is angled generally upward from the back of the brake carriage and is pointed towards the front of the skate. A support collar 182 helps to support the lever arm 180. A cam 184 has a pull point 186, a leverage point 188, and a connecting point 190. A brake pad 40 is mounted in the carriage 20 and the carriage is pivotally connected to a skate (not shown) at the axle of the rearmost wheel 14.

Connecting point 190 of the cam 184 is connected to the lever arm 180 at a point near the end of the lever arm furthest removed from the back of the carriage 20. A cable 82 is attached to pull point 186 of the cam. when the cable is engaged, the lever arm 180 will rotate the carriage 20 about the axle of the wheel, driving the brake pad down to the ground. A spring, not shown, may provide the counter-force for holding the carriage above the skating surface when the brake is not engaged.

The leverage point 188 of cam 184 is used to adapt the lever arm 180 and cam to variously shaped skates. A rod (not shown) may be passed through leverage point 188 to hold the cam against the lever arm at a predetermined angle. By altering the location of leverage point 188 within the cam 184, the geometry of the cam action will be changed. The introduction of the leverage point 188 permits a variable fitting of the carriage 20 to differently shaped skates with only a change-over of the cam 184, rather than a complete redesign and change-over of the carriage 20 and lever arm 180. Because a change of the location of leverage point 188 in cam 184 should be appreciably easier and more cost-effective than a change of the carriage and lever arm, this feature makes the carriage more readily available to a wide range of skates at a relatively modest design and development cost.

FIG. 14 shows a side view of the carriage of FIG. 15, in which it may be seen that the brake pad 40 may be securely attached to carriage 20 by bolt 192 within the carriage. In FIG. 14, it may be seen that a housing 194 may cover the carriage assembly.

The foregoing description of the carriage delivery mechanism of this invention is to be understood in light of the further description of various refinements and variations to the system of this invention which follows, as well as in light of adaptations readily apparent to those skilled in the art. In particular, and among other variations, it will be understood that the carriage does not require a separate back connecting member, does not require anything other than a single muff shaped piece, need not be placed at an axle of the skate, and need not be placed at the axle of the rearmost wheel.

Basic Plunger Delivery Mechanism

Figure 10:
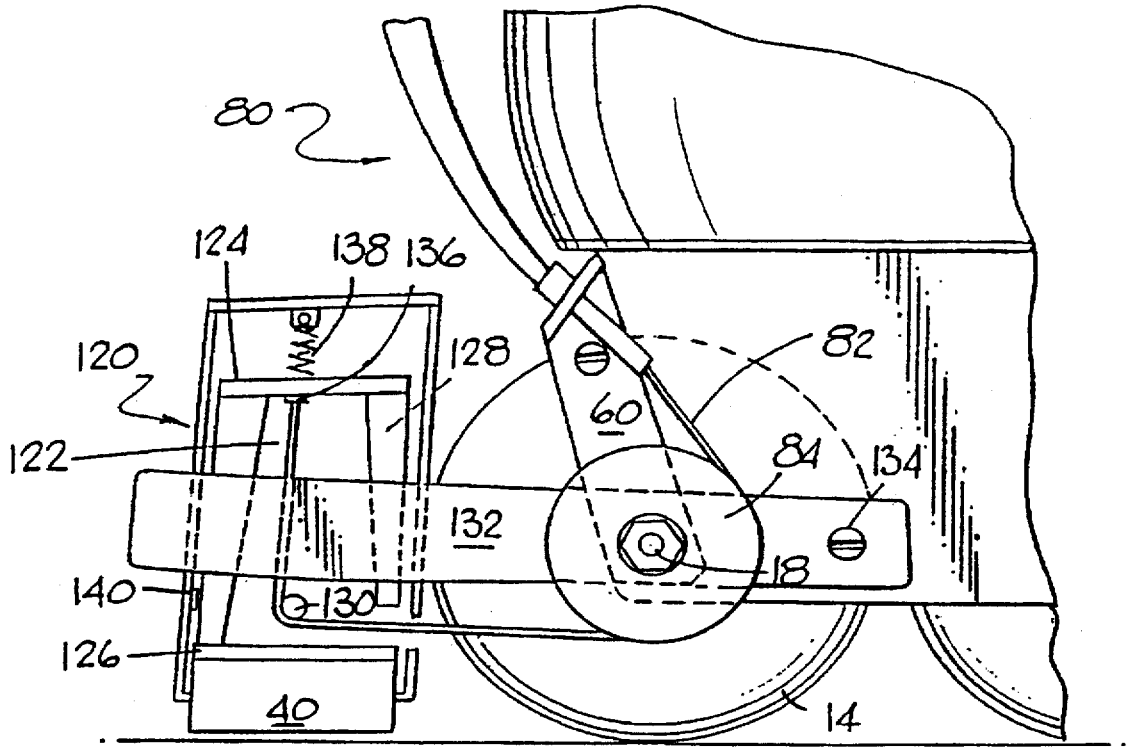
FIG. 10 is a side elevational, partially cut away view of a plunger embodiment of the delivery mechanism of the brake system of this invention.

With reference to FIG. 10, it can be seen in overview that a basic plunger delivery mechanism of the brake system of this invention includes a plunger housing 120, a brake pad 40, an actuator support arm 60, and an actuator assembly 80 (for ease of reference, structures which are common to the plunger delivery mechanism and the delivery mechanisms already discussed will be designated with identical numerals). Moreover, many of the workings of the plunger delivery mechanism are the same as the other delivery mechanisms and will not be repeated here in detail. In this embodiment, pulleys 84 and 130 serve as the variable force mechanism, and a bead 140 within the plunger housing 120 serves as the arresting mechanism.

The plunger housing 120 houses a plunger 122 having atop surface 124 and a bottom surface 126 joined together by a plunger wall- 128. In a preferred embodiment, plunger 122 is channeled and hollowed in order to accommodate cable 82 and pulley 130 in the interior of the plunger, but it should be understood that the plunger may be constructed many other ways, including by fabricating an open frame that joins the top and bottom surfaces.

The plunger housing is mounted to the rear of the skate and is oriented so that the plunger axis is generally vertical relative to the skating surface. in this embodiment, the housing 120 is mounted to a support 132 which wraps around the rear of the skate. Support 132 is secured to the skate at the axle 18 of the rearmost wheel 14, and is further secured by bolt 134.

The brake pad 40 is fixed to the bottom surface 126 of plunger 122. The bottom surface 126 works as does the brake mounting plate 28 already discussed with reference to the other delivery mechanisms. Bottom surface 126 and brake pad 40 may include the bolt, nipples, holes and other structures previously discussed, with such adaptations as would be easily understood by one skilled in the art to secure the attachment of brake pad to bottom surface of the plunger.

The plunger housing 120 is operatively connected to the actuator assembly 80. in this embodiment, the actuator assembly includes a cable 82 having a linkage carried in an actuator housing 62 of the actuator support arm 60, and a pulley 84 mounted on the axle 18.

Plunger 122 is connected to cable 82 of the actuator assembly 80 at retaining pin 136. Cable 82 runs from the retaining pin, around pulleys 130 and 84, and to the linkage carried in actuator housing 62.

It can be understood that, when the actuator assembly 80 is engaged so as to pull the cable 82 towards the actuator housing 62, the resultant force will pull the plunger 122 downwards towards the skating surface. This movement will urge the brake pad 40 towards the ground where it will engage the skating surface to stop the skate.

A tension spring 138 is attached, at one end, to the top surface 124 of the plunger and, at the other end, to the plunger housing 120 near the top of the housing. Thus, when the cable 82 is not engaged, the spring tension will pull the plunger upwards. This tension will urge the brake pad 40 away from the ground where it will ride until activated by the actuator assembly 80.

An arresting bead 140 within the plunger housing 120 can now be understood to operate as an emergency brake. In the event that some component of the actuator assembly 80 should fail, the system of this invention uses the arresting bead 140 to simulate the working of a traditional toe-raised brake. it can be seen that the arresting bead 140 extends inward from the interior wall of the housing 120.

In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although plunger 122 will be pushed upwards, the arresting bead 140 will contact the outer lip of the bottom surface 126 of the plunger so as to limit the range of movement, and will lock the plunger in place at the limit of movement. Locked into place, the housing 120 holds the brake pad 40 against the skating surface so that the brake pad will drag against the ground and bring the skater to a stop.

The plunger housing and plunger assembly just described use a direct pull to bring the plunger down towards the skating surface. It should be readily understood that other, equivalent mechanisms may also be used, including mechanisms using worm gears, levers and like devices to gain a further mechanical advantage.

Figure 17B:
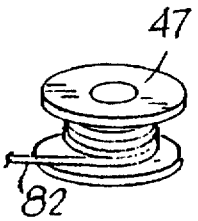
FIGS. 17A and 17B are perspective views of a worm gear and spool for use in the system of this invention.
Figure 17A:
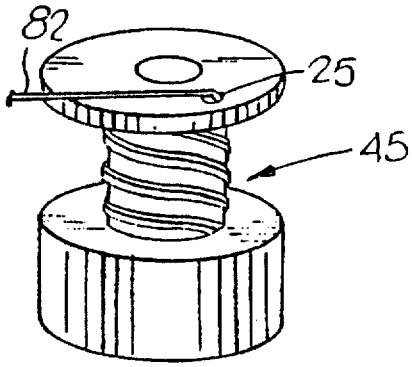

For example, a worm gear of the type shown in FIG. 17A, or a take-up spool of the type shown in FIG. 17B could replace the pulleys just discussed. With reference to FIG. 17A, and with the worm gear 45 shown therein mounted inside the plunger housing, a cable 82 attached to pull point 25 and a spring-loaded counter-force (not shown) could drive the brake pad 40 to the ground when the brake is engaged and hold it above the ground when not engaged. So also, the take-up spool 47 of FIG. 17B, mounted inside the plunger housing, with a cable 82 attached to the spool 47 and with a counter-force, could drive the brake pad 40 to the ground when the brake is engaged and hold it above the ground when not engaged.

Basic Side Rail Delivery Mechanism

Figure 11:
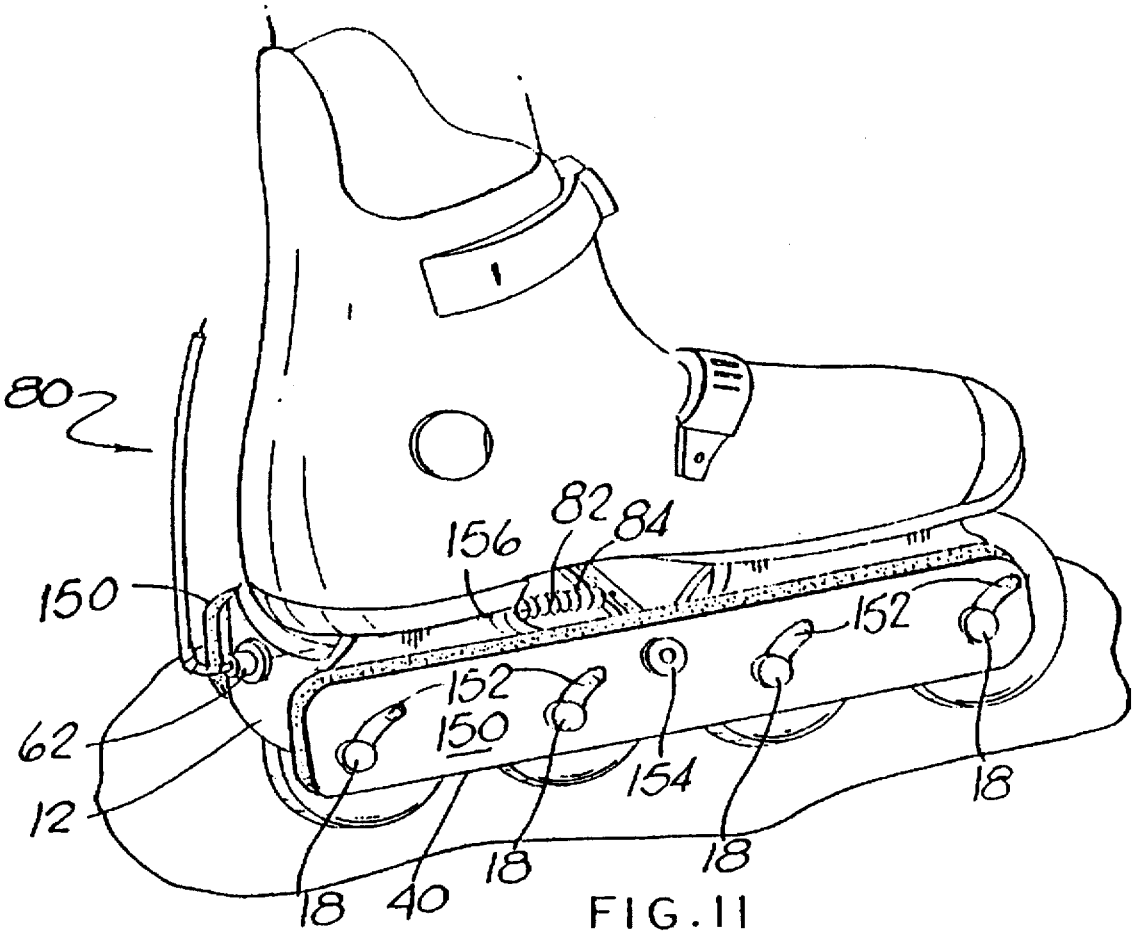
FIG. 11 is a perspective view of a side rail embodiment of the delivery mechanism of the brake system of this invention.

With reference to FIG. 11, it can be seen in overview that a basic side rail delivery mechanism of the brake system of this invention includes a pair of side rails 150 and brake pads 40, an actuator housing 62, and an actuator assembly 80 (for ease of reference, structures which are common to the side rail delivery mechanism and the delivery mechanisms already discussed will be designated with identical numerals).

Each side rail 150 is attached to the frame 12 of a skate by way of four cut-outs 152. The cut-outs are disposed so as to fit over the axles 18 of the wheels of the skate, and are shaped as elongated groves describing a path along which the side rails may move. The two side rails are connected to one another by a rod 154. Cable 82 of the actuator assembly 80 runs from rod 154 through actuator housing 62.

Figure 12:
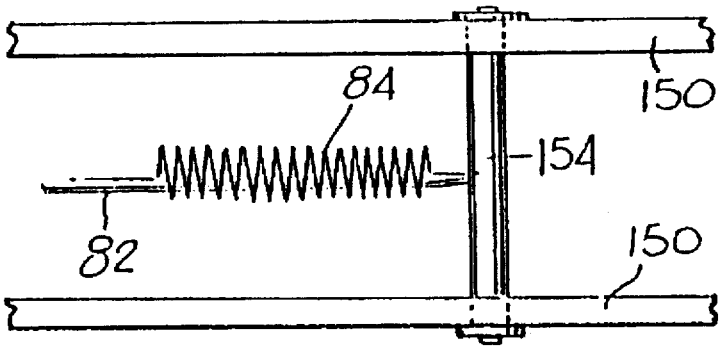
FIG. 12 is a top plan view of certain details of FIG. 11.

When the actuator assembly 80 is engaged so as to pull cable 82 towards the actuator housing 62, the resultant force will pull rod 154 towards the rear of the skate, forcing the two side rails down in the path described by the cut-outs 152. As can be seen with reference to FIG. 11, the elongated groove of each of the cut-outs describes an arc so that the side rails are urged towards the ground when the actuator is engaged. This movement drives the brake pads 40 to the ground. A compression spring 84 is attached, at one end, to rod 154 and, at the other end, to a stop bar 156. Thus, when the cable 82 is not engaged, the spring force will push rod 154 towards the front of the skate, urging the brake pads 40 away from the ground where they will ride until activated by the actuator assembly 80. with reference to FIG. 12, rod 154, cable 82, and spring 84 may be seen between the two side rails 150 (with certain other details of FIG. 11 omitted).

An Alternate Side Rail Delivery Mechanism

Figure 13:
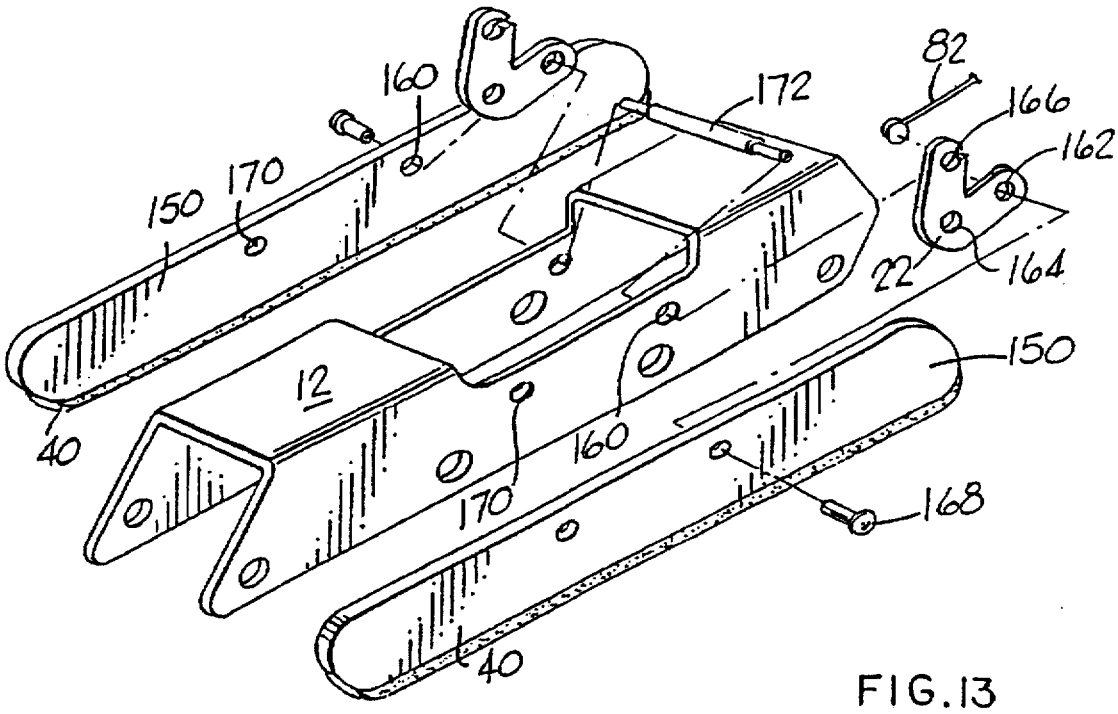
FIG. 13 is an exploded perspective view, showing an alternative embodiment of a side rail delivery mechanism of this invention.

The side rail delivery mechanism just discussed makes use of the axles of the wheels and associated cut-outs 152 to drive the side rails 150 towards the ground. With reference to FIG. 13, an alternative arrangement may be seen. A standard skate frame 12 can be adapted to work with two side rails 150 by drilling a first pair of holes 160 and a second pair of holes 170 from one side of the frame to the other.

A rocker arm 22 has a pivot point 162, a tie rod point 164, and a pull point 166. A rivet 168 passes through the side bar 150, pivot point 162 of rocker arm 22, and hole 160 of the frame 12. An identical arrangement of a rocker arm (shown but not separately numbered in FIG. 13) on the opposite side of the frame connects the other side rail 150 to the frame. A tie bar 172 joins the tie rod points 164 of the two rocker arms 22 together.

An identical pair of rocker arms (not shown in FIG. 13) is attached between the side rails 150 and the frame 12 at points 170. It should be understood that there are a total of four rocker arms 22, one pair at points 160 and the other pair at points 170 of the frame. Thus, each of the side rails 150 is pivotally held in place by two rocker arms, one rocker arm at point 160, and another rocker arm at point 170.

Cable 82 is attached to pull point 166 of a rocker arm 22. When the cable is engaged, the side rail 150 will swing about the rocker arm pivot point 162 and will be urged towards the ground. As a result, brake surface 40 will be driven against the ground for stopping the skate. A counterforce may be provided by a spring (not separately shown, but readily understood by persons skilled in the art) for holding the side rails above the skating surface when the brake is not engaged.

Basic Integrated Delivery Mechanism

Figure 21:
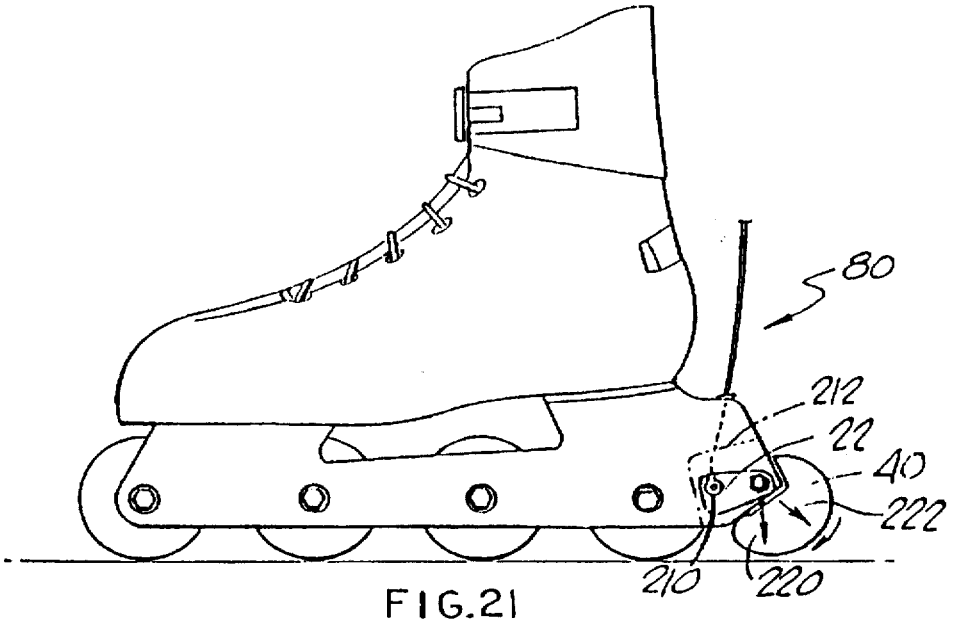
FIG. 21 is a side elevational view of an integrated embodiment of the delivery mechanism of the brake system of this invention.

With reference to FIG. 21, it can be seen in overview that a basic integrated delivery mechanism of the brake system of this invention includes: a rocker arm 22, a brake pad 40, and an actuator assembly 80 (for ease of reference, structures which are common to the integrated delivery mechanism and the delivery mechanisms already discussed will be designated with identical numerals). Each of these elements will be discussed individually, and with reference to FIG. 22 before returning to FIG. 21 for a discussion of the elements in combination.

Figure 22:
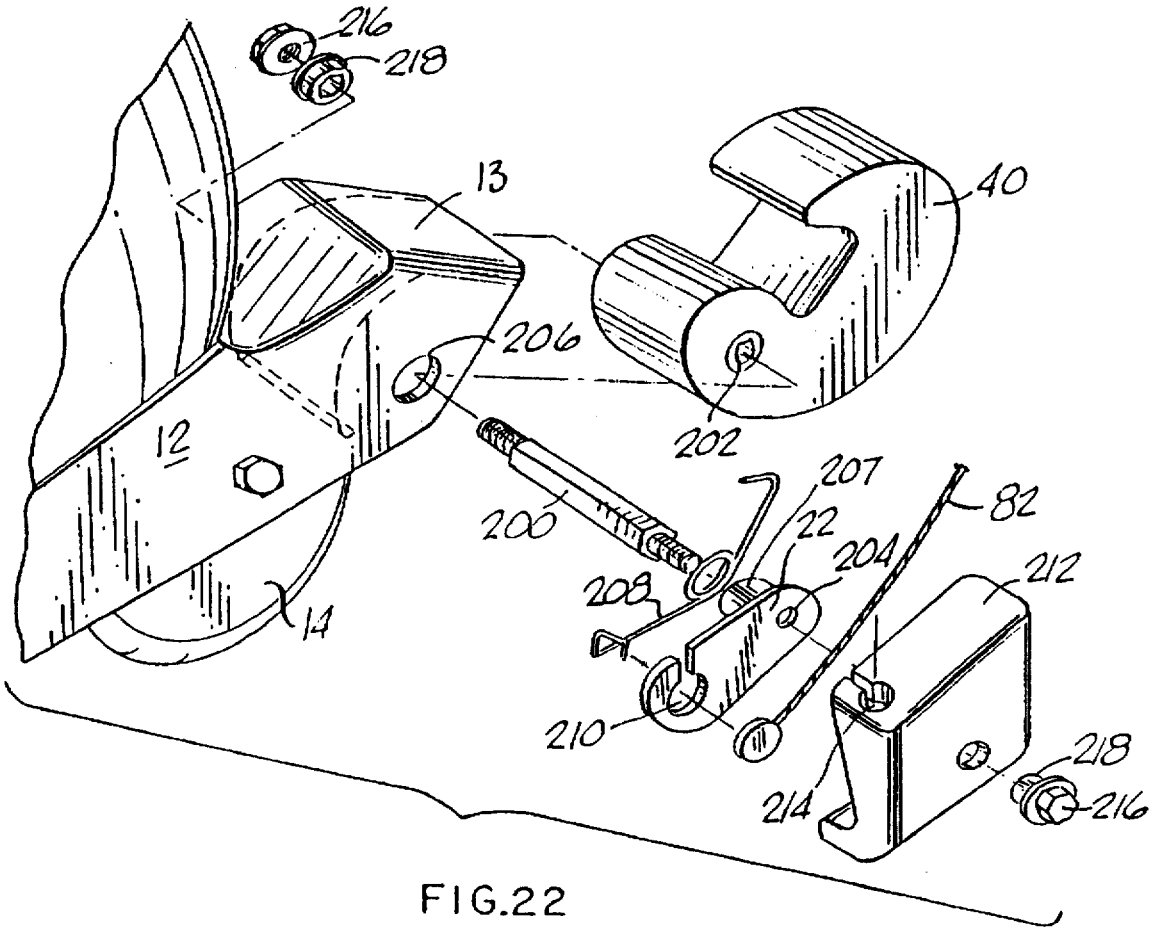
FIG. 22 is an exploded perspective view of the integrated embodiment of FIG. 21.

Referring to FIG. 22, it can be seen that this integrated delivery mechanism is specially adopted to be fitted into an existing skate frame 12 which has a built-in brake housing 13 designed to accommodate a conventional toe-raised fixed brake. That is, in such an existing housing, a brake pad would be fixedly mounted within housing 13, and the skater would stop the skate by raising the toe of the skate so as to pivot the skate about the axle of the rear wheel, thereby driving the housing 13 (which would carry the fixed brake) to the ground.

Because housing 13 is integrally formed within the frame 12 of an existing skate, the delivery mechanisms of this invention previously discussed would be impossible, or at least very awkward, to mount behind the rearmost wheel of such a skate. The integra.Led delivery mechanism of this invention makes use of the existing housing 13, and allows the advantages of this invention to be realized even in such a skate. In the discussion which follows, it must be understood that the preexisting brake pad which would have been mounted within housing 13 has been removed and discarded, leaving the housing 13 open for receiving the device of this invention.

For this integrated delivery mechanism, a specially shaped brake pad 40 is used. Brake pad 40 is of a compound shape, in cross section being roughly circular, but having an eccentric radius to create an elliptical aspect. Further, the cross section may display a cut-out from the center towards the surface so as to further inscribe a "C" shape to the brake pad 40. The purpose of this cut-out will be explained later.

Rocker arm 22 is joined to brake pad 40 by a shaped axle 200 that passes through a reciprocally shaped opening 202 in the brake pad. As shown, the shaped axle and reciprocal opening are hexagonal. The shaped axle 200 is passed through the opening 202 of the brake pad, thereby effectively locking the brake pad 40 to the axle 200. As can be seen, axle 200 is carried within housing 13 at pivot points 206. With the locked axle/brake pad unit set inside housing 13, the rocker arm 22 may be slid onto an end of the axle 200 at rocker arm pivot point 204. Pivot point 204 has a shaped connecting end 207 (hexagonally shaped in this example) for locking the rocker arm to the axle.

Other components in the integrated unit of this invention include a spring 208; a cable 82 having an end affixed to the rocker arm 22 at point 210; a cover 212 having a cutout 214 to accommodate the cable 82; and lock nuts and washers 216 and 218 to hold the axle 200 in place.

Referring now to FIGS. 21 and 22 in combination, it should be understood that, when the actuator assembly 80 is engaged so as to pull the cable 82, the resulting force will pull the rocker arm at point 210. This will rotate the shaped axle 200 and carry the brake pad 40 in rotation with the axle 200. The eccentricity of the radii (for example, radii 220 and 222 with reference to FIG. 21) of the brake pad is predetermined so that the elliptical "bulge" of the pad will be driven to the ground with the rotation of axle 200 where it will engage the skating surface to stop the skate. This effect may be enhanced by setting the axle 200 off-center through the brake pad 40, as shown (it being noted that shaped opening 202 is placed closer to the circumference than to the center of the brake pad). The spring 208 provides a counterforce so that the brake will ride above the ground when not engaged.

The size and shape of the brake within the housing 13 create an arresting mechanism that may operate as an emergency brake. In the event that some component of the actuator assembly 80 should fail, the skater may lift the toe of the skate, bringing the brake pad 40 into contact with the ground. Although the brake pad may rotate about the axle 200 to some extent, a limit will be reached at which point the elliptical bulge of the brake will lock against the inside of the housing 13. Locked into place, the brake pad 40 will hit the skating surface as the skater raises the toe of the skate so that the brake pad will drag against the ground and bring the skater to a stop.

It was previously mentioned that the brake pad 40 may have a cut-out from the center towards the surface so as to further inscribe a "C" shape to the brake pad 40. The reason for this is that many of the existing fixed housings such as housing 13 have a support bar running across the opening into which the brake pad 40 is to be placed. The cut-out is designed to fit around any such support bar. It may be appreciated that the brake pad 40 must be designed with regard to the housing 13 into which it will be placed, and will be of a width so as to fit snugly into the housing. Although the details of the shape and fit will depend upon the housing, and cannot be given in the abstract, any person skilled in the art will be able to determine the appropriate shape and fit once a particular housing is selected.

An Alternate Integrated Delivery Mechanism

Figure 29:
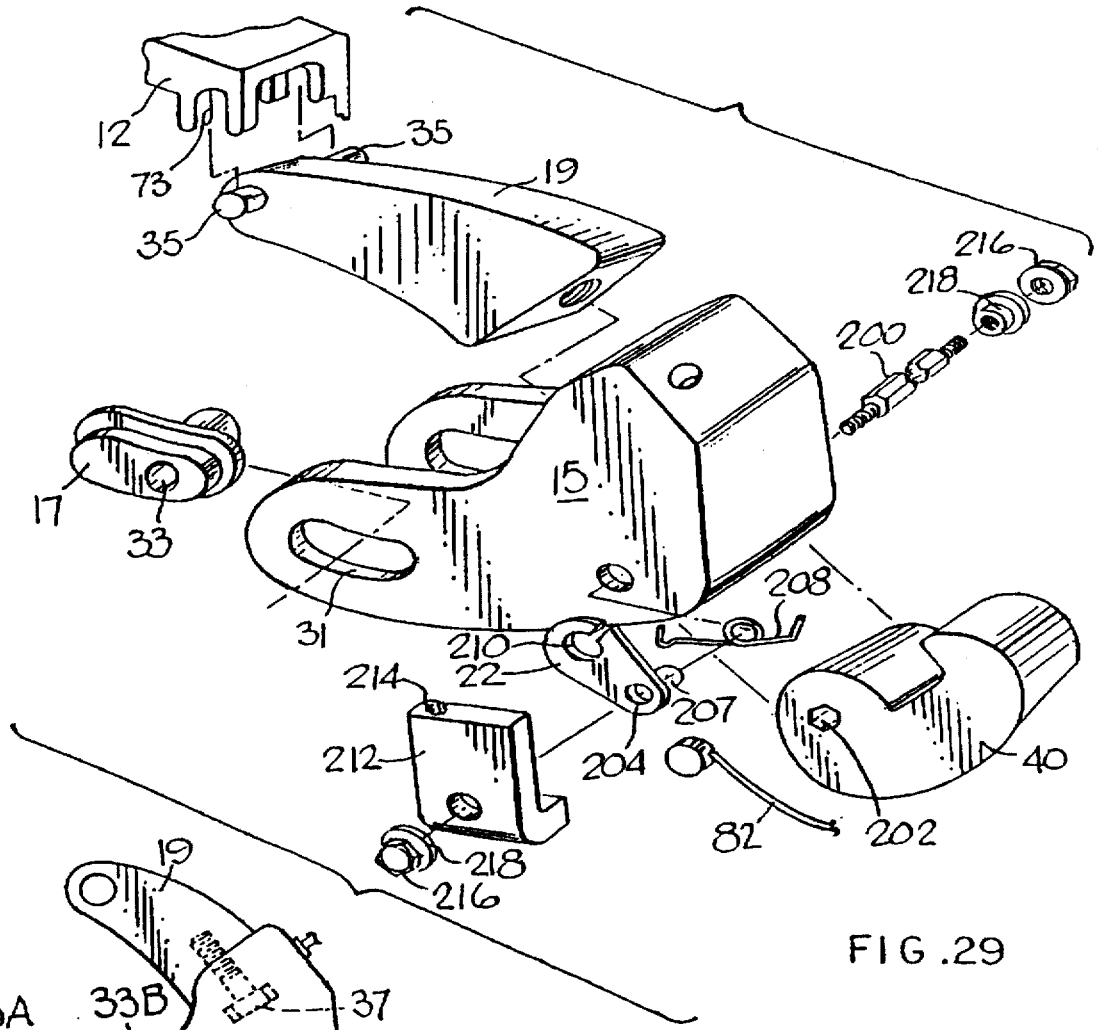
FIG. 29 is an exploded perspective view of an integrated embodiment of the delivery mechanism of the brake system of this invention, showing a modular housing with cam and support member.
Figure 30:
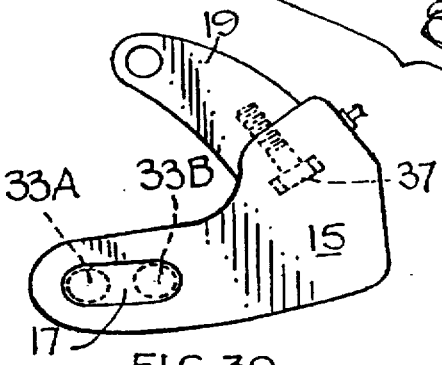
FIG. 30 is a side elevational view of the integrated delivery mechanism of FIG. 29.

Another embodiment of the basic integrated delivery mechanism just discussed in connection with FIGS. 21 and 22 is shown in FIGS. 29–30. This alternate embodiment is similar in general operation to the basic embodiment, but it begins from a different premise and a different starting point.

The premise of the basic integrated unit is that the choice of brake systems was constrained by the fact of a pre-existing housing (reference 13 in FIG. 22) that is not easily removable. Making the best of the situation, the basic integrated delivery mechanism turns the existing housing 13 to good advantage, and builds a ground engaging movable brake into the fixed housing 13.

The premise of this alternate integrated unit is that some skaters may prefer, and some skates may be better suited for, an integrated type of delivery mechanism rather than one of the other delivery mechanisms already discussed. The starting point, therefore, is a brake frame that does not have a pre-existing fixed housing, but to which something like the delivery mechanism of FIGS. 21 and 22 is nevertheless desired to be affixed.

With reference to FIG. 29, it may be seen that the rear frame 12 of an existing skate may contain a grooved channel 73. A housing 15, a cam 17, and a support arm 19 provide the basis for creating an integrated delivery mechanism for use with frame 12.

Cam 17 is inserted into slot 31 of the housing 15, and this unit is fixed to the skate at an axle (which could be the axle of the rearmost wheel, or could be another axle near the back of the skate), with the axle passing through hole 33 of the cam. Support arm 19 is connected at one end thereof to housing 15 by any convenient means, such as a bolt. The support arm 19 carries, at its other end, a set of adapting pegs 35 which lock into grooved channel 73 of the frame 12. Thus, attached to the skate at an axle through the cam 17 of the housing 15, and at the back of the frame 12 by the support arm 19, the housing is rigidly fixed behind the skate.

Into the housing 15, a ground engaging movable brake may be set, precisely as in the basic embodiment just discussed with reference to FIG. 22. Looking at FIG. 29, it can be seen that this embodiment contains the same components as the basic integrated delivery mechanism, including the elliptically shaped brake pad 40; rocker arm 22; shaped axle 200; reciprocally shaped opening 202 in the brake pad 40 for locking on to the axle; pivot point 204 of the rocker arm with shaped connecting end 207 for locking on to the axle 200; spring 208; cable 82 having an end affixed to the rocker arm 22 at pull point 210; a cover 212 having a cut-out 214 to accommodate the cable 82; and lock nuts and washers 216 and 218 to hold the axle 200 in place.

With these components set into the housing 15, and with the housing fixed to the skate, this alternate embodiment works just like the basic integrated delivery mechanism already described with reference to FIGS. 21 and 22, and that description will not be repeated here.

FIG. 30 is a side view of the housing 15 of the embodiment of FIG. 29, showing the support arm 19 connected to the housing by an embedded bolt 37. It should be understood that cam 17 is not essential (because the axle could simply run through a hole in the housing 15 for connection to the skate), but is provided as a feature for ease of use. As shown in phantom in FIG. 30, the location of hole 33 of the cam 17 may be alternated, and the alternate locations are designated 33A and 33B.

The advantage of this is that skate frames and wheels come in multiple sizes. In order to dispose the housing 15 so that it rides at the proper distance above the skating surface, one could either produce a large number of housings, each appropriate for a particular skate; or one could produce one or only a few housings, adapting the housing to a particular skate by way of the cam. It should be appreciated that it will be easier and more efficient to produce only one or a few housings with a number of adjustable cams, rather than to produce a large number of custom fitted housings.

Figure 31:
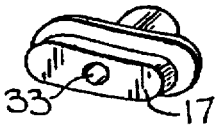
FIG. 31 is a perspective view of an alternative cam for use in the integrated delivery mechanism of FIG. 29.

Thus, with reference to FIG. 30, it can be understood that, with the axle running though hole 33A of cam 17, the housing 15 will ride relatively further away from the skating surface than it would with the axle running through hole 33B. This effect can be achieved by using a single cam with both holes 33A and 33B. The effect can also be achieved by using different cams for different skate geometries. FIG. 31 shows another cam 17 with hole 33 disposed nearly in the center to provide yet another adjustment to the position of the housing.

Figure 32:
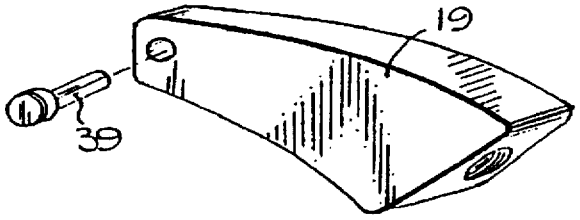
FIG. 32 is a perspective view of an alternative support for use in the integrated delivery mechanism of FIG. 29.

Finally, it should be noted that the grooved channel 73 of frame 12 shown in FIG. 29 is based on one existing inline skate model. Other models lack such a channel, but have holes near the back of the frame. On yet other models, there are no holes, but holes may be drilled through the frame. For such models as those, FIG. 32 illustrates a support arm 19 that may be fixed to the frame of a skate by a rivet 39. The support arm of FIG. 32 would then be fitted to a housing as previously described with reference to FIG. 29.

The foregoing detailed description explains the five basic delivery mechanisms of the ground engaging movable brake of this invention, together with certain alternate embodiments of those delivery mechanisms. The foregoing description also introduced such other elements of this invention as the variable force mechanism, the arresting mechanism, the brake surface, and the actuator mechanism. with these five delivery mechanisms (rocker arm, carriage, plunger, side rail, and integrated unit) and related systems in mind, certain variations of the variable force mechanism will now be discussed.

VARIABLE FORCE MECHANISMS

The variable force mechanism of this invention enhances the operation of the delivery mechanisms. Among the specific embodiments of the variable force mechanism are those that incorporate a lever, a cam, a pulley, and/or a worm gear.

Previously Described Levers

It has already been explained with reference to the basic rocker arm delivery mechanism (see FIG. 1) that a lever end 30 of the rocker arm 22 serves as a variable force mechanism. Levers are also shown in the rocker arms that are included in the side rail delivery mechanism previously discussed (see rocker arm 22 in FIG. 13).

Previously Described Pulleys

Pulleys have been explained in connection with the basic carriage delivery mechanism (see pulley 84 in FIG. 6), and in the basic plunger delivery mechanism (see pulleys 84 and 130 in FIG. 10) previously discussed.

Previously Described Lever and Cam

A lever and cam arrangement has been explained in connection with the alternate carriage delivery mechanism (see lever 180 and cam 184 in FIGS. 14 and 15).

So also, the rocker arms of FIGS. 16A–16E all can be understood to use a lever action as the rocker arm rotates about the pivot point 23. These rocker arms can also be understood to involve a cam or a cam-like action when the cable 82 is set so as to pull about the circumference of the circular-shaped member of the rocker arm.

Previously Described Worm Gear and Take-Up Spool

A worm gear (reference FIG. 17A) and a take-up spool (reference FIG. 17B) have been explained in connection with the basic plunger delivery mechanism.

ARRESTING MECHANISMS

The arresting mechanism of this invention provides an emergency back-up in the event that the delivery mechanism should fail. The most basic version of the arresting mechanism (already explained with reference to FIGS. 1–5 for the rocker arm delivery mechanism; FIGS. 6–9 for the carriage delivery mechanism; and FIG. 10 for the plunger delivery mechanism) is a post or bead disposed in the path of the delivery mechanism to lock the delivery mechanism in place so as to duplicate the action of a conventional toe-raised brake for emergency stopping.

FIGS. 18A–18G show several alternate ways of incorporating the arresting mechanism. For ease of reference, all of the arresting mechanisms will be shown with a rocker arm delivery mechanism, and each rocker arm, and the common elements of the various versions will be designated with identical numerals.

Figure 18A:
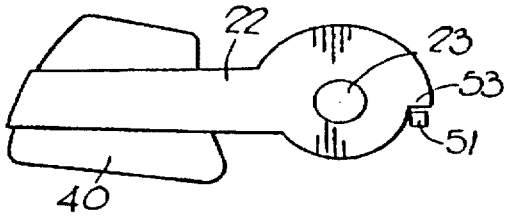
FIGS. 18A–18G are side elevational views of alternative arresting mechanisms for use in the system of this invention.

In FIG. 18A, the rocker arm 22 holds brake pad 40 at one end of the rocker arm. The other end of the rocker arm is circular in shape, having a pivot point 23. it can be understood that an actuator could urge the rocker arm to rotate about the pivot point so as to drive the brake pad 40 to the ground. In the event that the actuator should fail, it should be understood that the skater could raise the toe of the skate, rotating the rocker arm so that the brake pad 40 is brought to the ground.

Although the rocker arm will be able to rotate about the pivot point 23 for a small distance, a post 51 is so disposed in the path of travel that a ridge 53 on the end of the rocker arm will hit the post at a limit of rotation. At this limit, the travel of the rocker arm 22 about the pivot point will be arrested, the rocker arm will lock into place, and the brake pad will be driven firmly into the ground. Thus the brake system of this invention can, in the event of an actuator failure, be made to simulate the action of a conventional toe-raised brake.

Figure 18B:
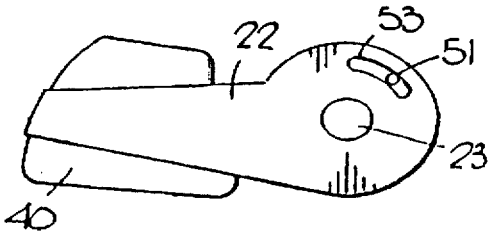

In FIG. 18B, the rocker arm 22 holds brake pad 40 at one end of the rocker arm. The other end of the rocker arm is circular in shape, having a pivot point 23. It can be understood that an actuator could urge the rocker arm to rotate about the pivot point so as to drive the brake pad 40 to the ground.

Although the rocker arm will be able to rotate about the pivot point 23 for a small distance, a post 51 is so disposed on the skate and in the path of travel of the rocker arm that a wall of cut-out 53 within the rocker arm will hit the post at a limit of rotation. At this limit, the travel of the rocker arm 22 about the pivot point will be arrested, the rocker arm will lock in to place, and the brake pad will be driven firmly into the ground. Thus the brake system of this invention can, in the event of an actuator failure, be made to simulate the action of a conventional toe-raised brake.

In FIG. 18B, the rocker arm 22 holds brake pad 40 at one end of the rocker arm. The other end of the rocker arm is circular in shape, having a pivot point 23. It can be understood that an actuator could urge the rocker arm to rotate about the pivot point so as to drive the brake pad 40 to the ground.

Although the rocker arm will be able to rotate about the pivot point 23 for a small distance, a post 51 is so disposed on the skate and in the path of travel of the rocker arm that a wall of cut-out 53 within the rocker arm will hit the post at a limit of rotation. At this limit, the travel of the rocker arm 22 about the pivot point will be arrested, the rocker arm will lock into place.

Figure 18C:
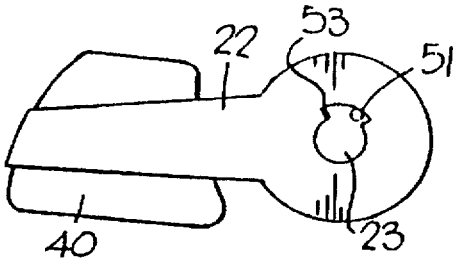
Figure 18D:
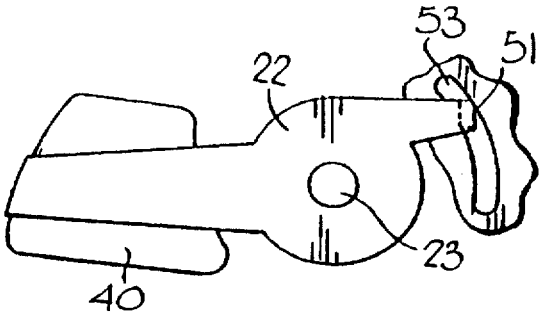

The arresting mechanisms of FIGS. 18C and 18D are variations on FIG. 18B.

In FIG. 18C, it can be seen that the cut-out 53 is oriented so as to be adjacent to the pivot point 23—a post 51 will hit the wall of cut-out 53 and lock the rocker arm.

In FIG. 18D, it can be seen that the cut-out 53 and post 51 are reversed from the arrangement of FIG. 18B. In the arresting mechanism of FIG. 18D, post 51 is an extension of the rocker arm and cut-out 51 is inscribed in the skate. As before, however, post 51 will hit the wall of cut-out 53 and lock the rocker arm.

Figure 18E:
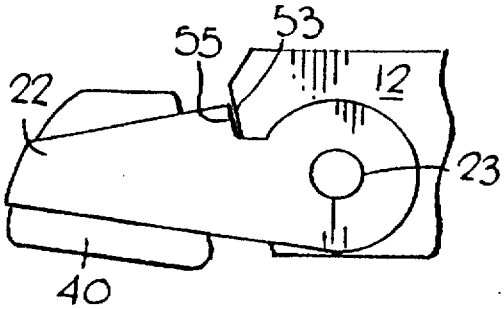
Figure 18F:
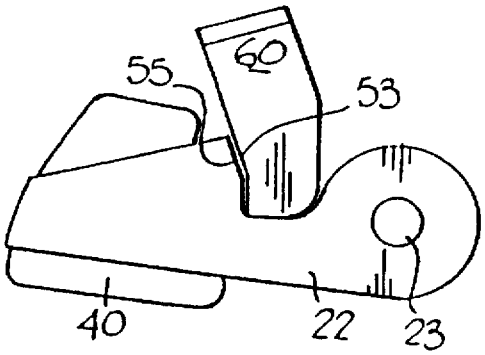
Figure 18G:
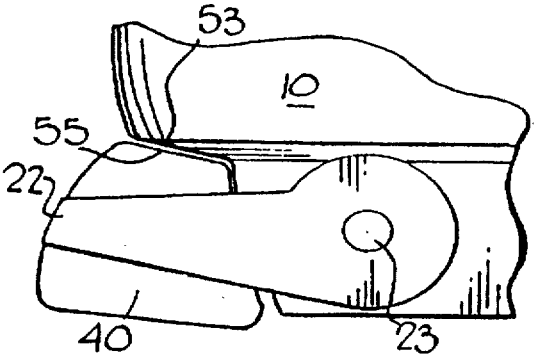

The arresting mechanisms of FIGS. 18E–18G are all variations involving the use of structures on the skate or skate frame to provide a fixed surface to lock the rocker arm into place.

In FIG. 18E, it can be seen that a surface 53 of the frame 12 of the skate can be oriented so as to be in the path of the rocker arm 22 so that a surface 55 of the rocker arm will hit surface 53 at a limit of rotation. As before, the rocker arm will be locked into place for emergency stopping.

In FIG. 18F, it can be seen that a surface 53 of the actuator arm 60 (see FIGS. 1, 5 and 6 for explanation of the actuator arm) of the brake system can be oriented so as to be in the path of the rocker arm 22 so that a surface 55 of the rocker arm will hit surface 53 at a limit of rotation. As before, the rocker arm will be locked into place for emergency stopping.

In FIG. 18G, it can be seen that a surface 53 of the skate boot 10 of the skate can be oriented so as to be in the path of the rocker arm 22 so that a surface 55 of the rocker arm will hit surface 53 at a limit of rotation. As before, the rocker arm will be locked into place for emergency stopping.

The foregoing description of the arresting mechanism of this invention is to be understood in light of adaptations readily apparent to those skilled in the art. in particular, and among other variations, it will be understood that the arresting mechanism is readily adapted for use with each of the delivery mechanisms of this invention. In all versions of the brake system of this invention, the arresting mechanism works so that, if the actuator should fail, the skater could raise the toe of the skate, rotating the rocker arm so that the brake pad 40 is brought to the ground, thereby simulating the working of a conventional toe-raised brake.

BRAKE SURFACES

The brake surface of the system of this invention is the element which is driven to the ground by the delivery mechanism. The most basic version of the brake surface is a pad, and this has been explained in connection with each of the delivery mechanisms so far discussed (for example, reference 40 in FIGS. 1–4, 6–9, 10–11, 13–16, 18, 23, and 24).

An alternative arrangement is the elliptical brake surface, in which a generally circular shape has eccentric radii so as to create an elliptical bulge Which serves as a braking surface. This version has been discussed with reference to FIGS. 21, 22, and 29, and the direct application of this version to the surface of a rocker arm has been explained in connection with the discussion of FIGS. 16D and 16E.

Figure 19:
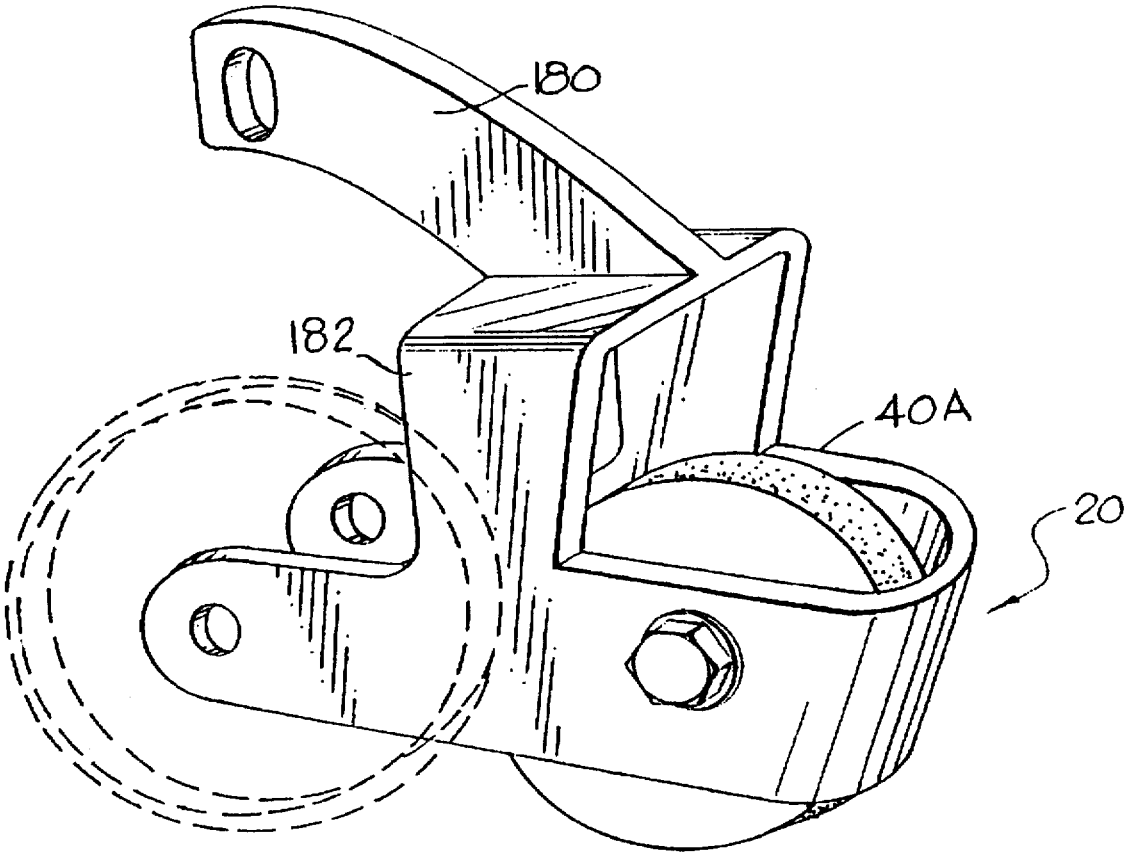
FIG. 19 is a perspective view of a friction wheel brake surface for use in the system of this invention.

In FIG. 19, yet another embodiment of the brake surface is shown. In a carriage type of delivery mechanism 20, having a lever arm 180 and support member 182, a friction-damped wheel 40A can be mounted. This carriage should be understood to work generally like the carriage structure of FIGS. 14 and 15, and the common elements will not be further discussed here. What sets the carriage of FIG. 19 apart is that the. brake surface is a wheel 40A instead of the brake pad 40 used in the embodiment of FIGS. 14 and 15.

The advantage of the friction damped wheel is that the brake surface 40A can be made to rotate as it comes into contact with the ground. In a way roughly analogous to an antilock automobile brake, the rotation of brake surface 40A against the ground will provide a good braking action. The friction to wheel 40A could be generated by friction bearings having a predetermined load, a clamp axle, or a preloaded tension spring. These are all well known to those skilled in the art and will not be described further.

Figure 20:
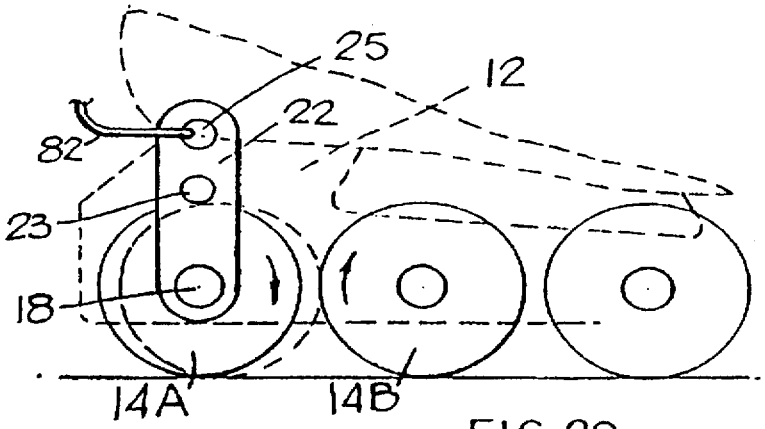
FIG. 20 is a schematic view of an alternative friction wheel for use in the system of this invention.

FIG. 20 shows a variation of the friction-damped wheel brake surface. A rocker arm 22 has a pivot point 23 and a pull point 25. Cable 82 attached to pull point 25 can rotate the rocker arm about the pivot point. In this embodiment, an end of the rocker arm holds axle 18 of a wheel 14A of a skate. The rocker arm 22 is so disposed that, when it rotates about pivot point 23, wheel 14A will be urged against another wheel 14B of the skate, thereby applying a rotating brake surface to stop the skate.

The foregoing description of the brake surface of this invention is to be understood in light of adaptations readily apparent to those skilled in the art. In particular, and among other variations, it will be understood that each brake surface is readily adapted for use with each of the delivery mechanisms of this invention. In all versions of the brake surface of this invention, a brake surface engages the ground and the brake surface moves in relation to the skate so that braking force is applied while the angle of the skate relative to the ground remains constant.

ACTUATOR MECHANISMS

The actuator mechanism is used to activate the delivery mechanism. Various versions of the actuator mechanism, with cables or with wireless components, and including a specially designed hand or foot or leg control, will be discussed.

Figure 25:
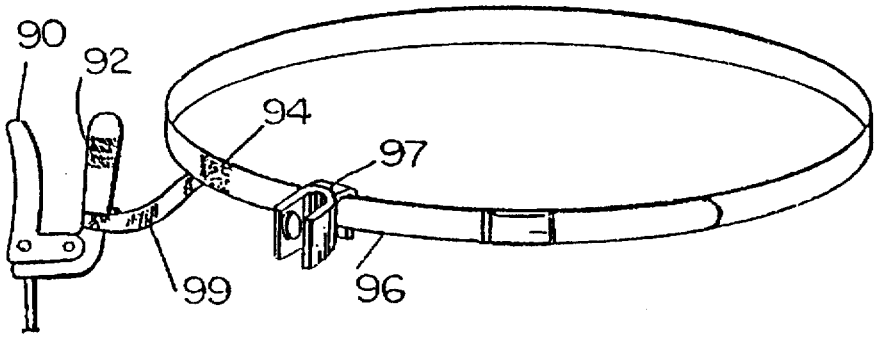
FIG. 25 is a perspective view of a belt for housing the hand-held controller(s) used to activate the brake system of this invention.

The most basic actuator assembly is activated by a handheld controller 90 (reference FIG. 25). To better accommodate the needs of a skater, this invention includes a VELCRO-brand hook and loop fastener 92 affixed to the controller 90, and a corresponding VELCRO-brand hook and loop fastener 94 which is placed on a belt 96. It can be seen that the skater may, when not holding the controller 90, readily place it on the belt 96 by the VELCRO-brand hook and loop fastenings. In addition, a holder clip 97 may be provided and the hand-held controller could be snapped into the clip.

For further convenience, and safety, the controller 90 is attached to the belt 96 by a strap 98. Strap 98 is designed to aid the skater in the event that the skater should drop the controller 90. Instead of dragging behind the skater on the ground, the controller 90 is retained by strap 98. The strap 98 may be made of elastic material in order that it may be relatively short (so that the controller 90 will be within reach if dropped) but also able to travel at arm's length (so that the skater will be able to hold the controller 90 at a comfortable distance from the body).

The hand-held controller 90 of FIG. 25 is a fairly standard item. one disadvantage is that it has an open handle so that the controller, if dropped, would easily snag posts or other stationary objects while the skater is still moving. This would create a sudden, and potentially unsafe stop. To address this concern, a specially designed hand-held controller is recommended for the system of this invention.

Figure 26:
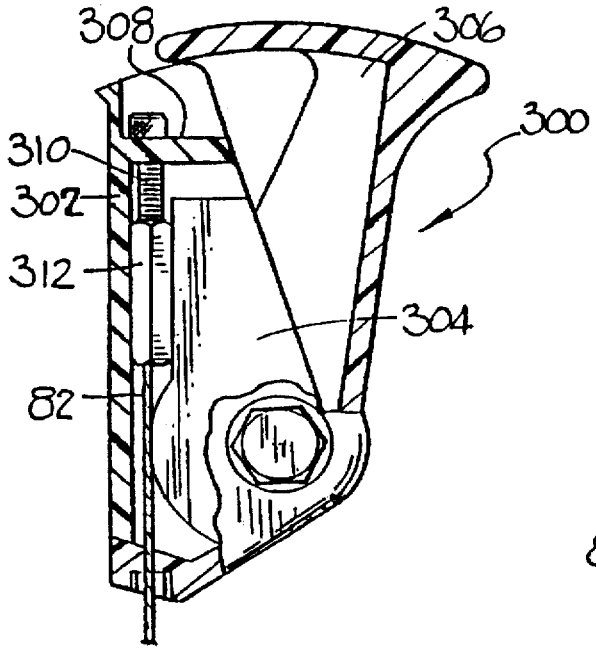
FIG. 26 is a cut away side elevational view of a preferred hand-held controller for use in the system of this invention, showing the controller in an uncompressed state.

With reference to FIG. 26, it may be seen that a handheld controller 300 has a trigger 302; a hand cam 304 rigidly attached to the trigger; a housing 306; a stand-off 308; an adjusting screw 310; a connector 312; and cable 82.

The trigger 302 and hand cam 304 are locked together and then seated within housing 306. Cable 82 is attached to connector 312, and adjustments are made by setting the stand off 308 and adjusting screw 310. All of this is well known to those in the art and will not be further discussed.

What is most significant about this hand-held controller 300 are these features: (a) the hand cam 304 and adjusting screw 310 allow every user to adjust the "feel" of the brake until he or she is satisfied with the brake action achieved with the pull of the controller trigger 302, and (b) the tension in the hand-held controller is such that when the trigger 302 is not actively being squeezed by the skater, it will be substantially covered by the housing 306, and will be "closed" rather than open. This last feature is meant to minimize the chance of a dropped controller snagging on a stationary object.

Figure 27:
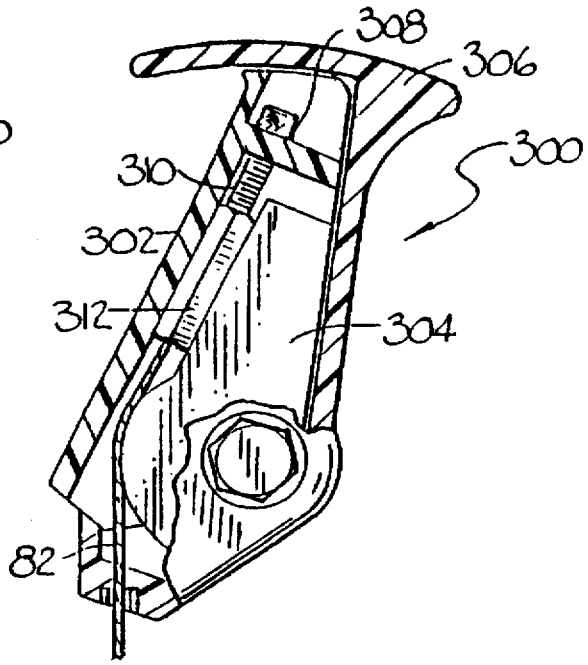
FIG. 27 is a cut away side elevational view of the controller of FIG. 26, showing the controller in a compressed state.

The "closed" orientation of the controller may be further understood by an inspection and comparison of FIGS. 26 and 27. In FIG. 27, the hand-held controller 300 just discussed is shown with the trigger 302 pulled, as a skater would do when squeezing on the trigger to activate the brake system. It can be seen that the trigger slides within a shelf (not separately numbered) at the top of the housing 306. By comparison, the controller of FIG. 26 is shown with the trigger 302 released, as when a skater is not touching the controller or is not activating the brake system. It can be seen that the trigger 302 is still substantially enclosed by the shelf and the rest of the housing 306. This safety feature is a reason for using a specially designed controller such as that of FIGS. 26 and 27 with the system of this invention, or with any remotely activated brake system.

While of the discussion so far has been in the context of a cable actuator, it should be apparent that the actuator need not be a cable-and-lever device. Because the cable can be seen as a drawback, it might be replaced by (a) a wireless electromechanical actuator, (b) a thin-wire electromechanical actuator.

Figure 28:
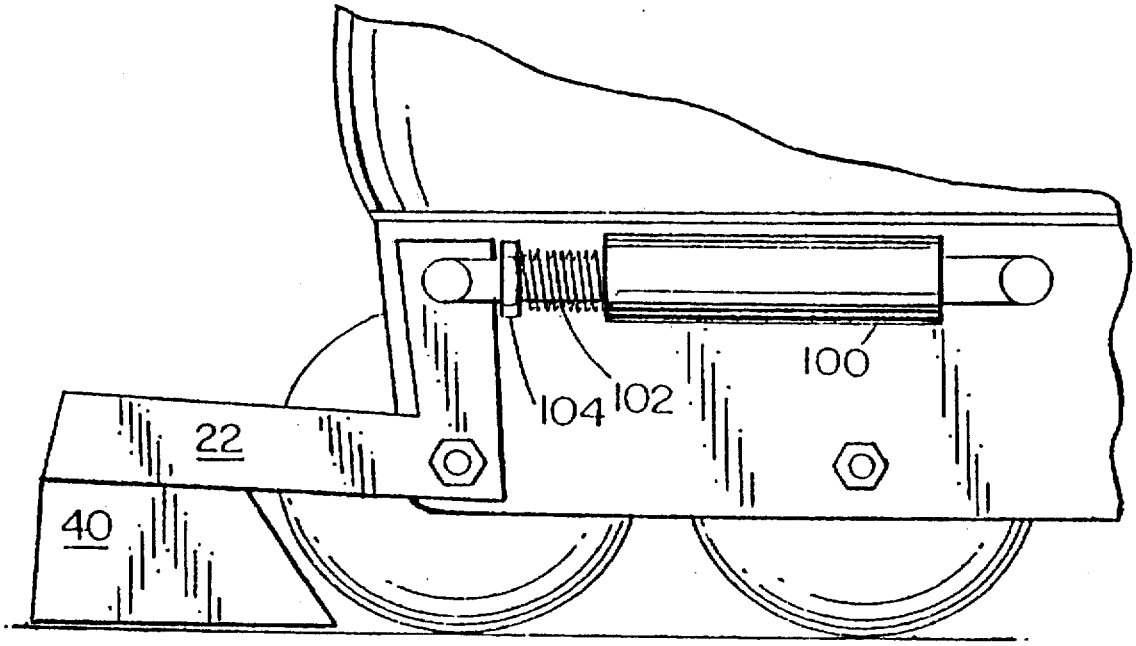
FIG. 28 is a side elevational view of the brake system of this invention showing a wireless activator.

In the wireless form, a radio-controlled method of activation is used. With reference to FIG. 28, it may be understood that a signal is sent to a solenoid 100 which activates rocker arm 22 (or equivalent element in the other delivery mechanisms shown). A spring 102 and spring tension adjuster 104 cooperate with the solenoid 100 to provide the forces in a first direction so as to bring the brake pad 40 into contact with the skating surface and in a second direction so as to carry the brake pad 40 above the skating surface when the brake is not engaged. A transmitter (not shown) may be carried in the skater's hand or on the waist with a battery pack or other power source attached to the skater, and the signal to activate the solenoid 100 is sent from the transmitter. The solenoid (and equivalent wireless controllers) is well known to persons skilled in the art, and will not be further described here.

In the thin-wire form (not separately shown), a transmitter and power source are attached to the skater's waist and a wire runs from the power source to a servomechanism on the skate which activates the rocker arm 22 (or equivalent structure in the other delivery mechanisms shown).

The foregoing descriptions of the actuator mechanism of this invention is to be understood in light of adaptations readily apparent to those skilled in the art. in particular, and among other variations, it will be understood that variations on the cable system include cable, wire, pneumatic, hydraulic, or electromagnetic elements. Likewise, an easily understood variation would be to reverse the push/pull orientation of the first and second forces of the actuator mechanism (that is, as discussed herein, a cable has been pulled to activate the delivery mechanism to drive the brake surface to the ground, and a spring has been used to push in the opposite direction—these actions could readily be reversed, if desired).

METHOD OF USE

The method of use of the brake system of this invention will now be explained. The method includes using a delivery system to drive a brake surface against the ground to stop the skate, with the delivery system being hand-activated by a mechanical device so as to bring a brake surface that is operatively connected to the delivery system into contact with the skating surface. This method permits the skater to activate the brake without changing the angle of the skate itself relative to the ground—that is, the skater need not lift or lower the heel or toe of the skate. This method also permits the brake pad to contact the skating surface rather than the wheel of the skate.

The method of this invention further includes the option of using two brakes, one on each skate (or with the compact rocker arms of FIGS. 16D and 16E, with two or more brakes in tandem on a single skate), and includes using hook and loop devices, and straps, to secure the hand controls needed to activate the brake. An emergency braking method involves lifting the toe of the skate, using an arresting bar or bead to lock the delivery mechanism, so that the skate may then be stopped like a traditional toe-raised brake. All of the various components necessary to carry out this method have already been explained.

METHOD OF INSTALLING THE BRAKE SYSTEM ON SKATES

An important condition to achieving the advantages of the brake system of this invention is, of course, that the system must be capable of practical installation in an in-line skate. Indeed, without a practical way either to retrofit existing skates or to fit newly manufactured skates, the objects of this invention would never be realized by skaters. Because of specific characteristics of this invention, a method for fitting the brake system disclosed herein both to existing in-line skates and to newly manufactured skates can be readily devised, and is disclosed as part of this invention.

The system of this invention also includes a method for retrofitting the brake to an existing skate. This retrofit method includes removing the axle bolts from the rear wheel of an existing skate; placing an element of the delivery mechanism or the brake surface itself over the axle; and then replacing the axle bolts so as to secure the system in place.

As has already been explained, the rocker arm pivot point (for example, the pivot point as shown in FIG. 1); the carriage delivery mechanism pivot point (as shown in FIGS. 6, 14, 15, and 19); the plunger housing support arm (support arm 132 in FIG. 10); and the side rail (side rail 150 in FIG. 11) all are designed to be fitted to a skate over the axle of the wheels.

An alternate method of retrofit involves removing a fixed brake pad from a fixed housing (such as housing 13 in FIG.

22) and setting a ground engaging movable brake within the housing in its place. This has been explained in connection with FIG. 22.

Additional retrofit options are provided by the alternate integrated delivery system previously discussed in connection with FIG. 29. in that case, a housing (housing 15 in FIG. 29) is attached to the frame of a skate, as already explained.

Further retrofit options are understood in light of the ability to place a rocker arm or other delivery mechanism away from the axle of a wheel, but upon an axle parallel to an axle of the wheel. The side rail 41 of FIG. 13 and the rocker arm of FIG. 24 are two examples.

It is just as easy, and perhaps easier, to place the system of this invention on a newly manufactured skate, using any of the techniques just discussed, but without the need to remove an existing element on the skate.

In summary, the brake system of this invention uses the skating surface (rather than a wheel of the skate) for generating stopping force while the angle of the skate relative to the ground remains constant, provides a large effective breaking surface which may be placed in contact with the skating surface, allows for a braking surface to be fitted to either or both skates, allows for an independent action of the material in contact with the braking surface, incorporates an emergency brake, can be readily installed in new or used skates, and conveniently retains all cables and hand-levers which are a part of the system.

SLIDING BRAKE MECHANISMS

The invention provides various alternative embodiments of braking mechanisms which employ a fixed member, and a slidable member having a braking surface. The slidable member slides along the fixed member to engage the ground without requiring the toe or heel of the skate to be either lifted or lowered. For example, the embodiment previously described in FIG. 10 includes such a fixed member and a slidable member. In one preferable aspect, the slidable member is moved into ground engagement by movement of the user's leg while the user's foot remains secured within a shoe or boot of the skate. In this manner, the braking surface of the slidable member may be brought into ground engagement simply by moving the leg while all of the skate's wheels remain in contact with the skating surface.

Figure 33:
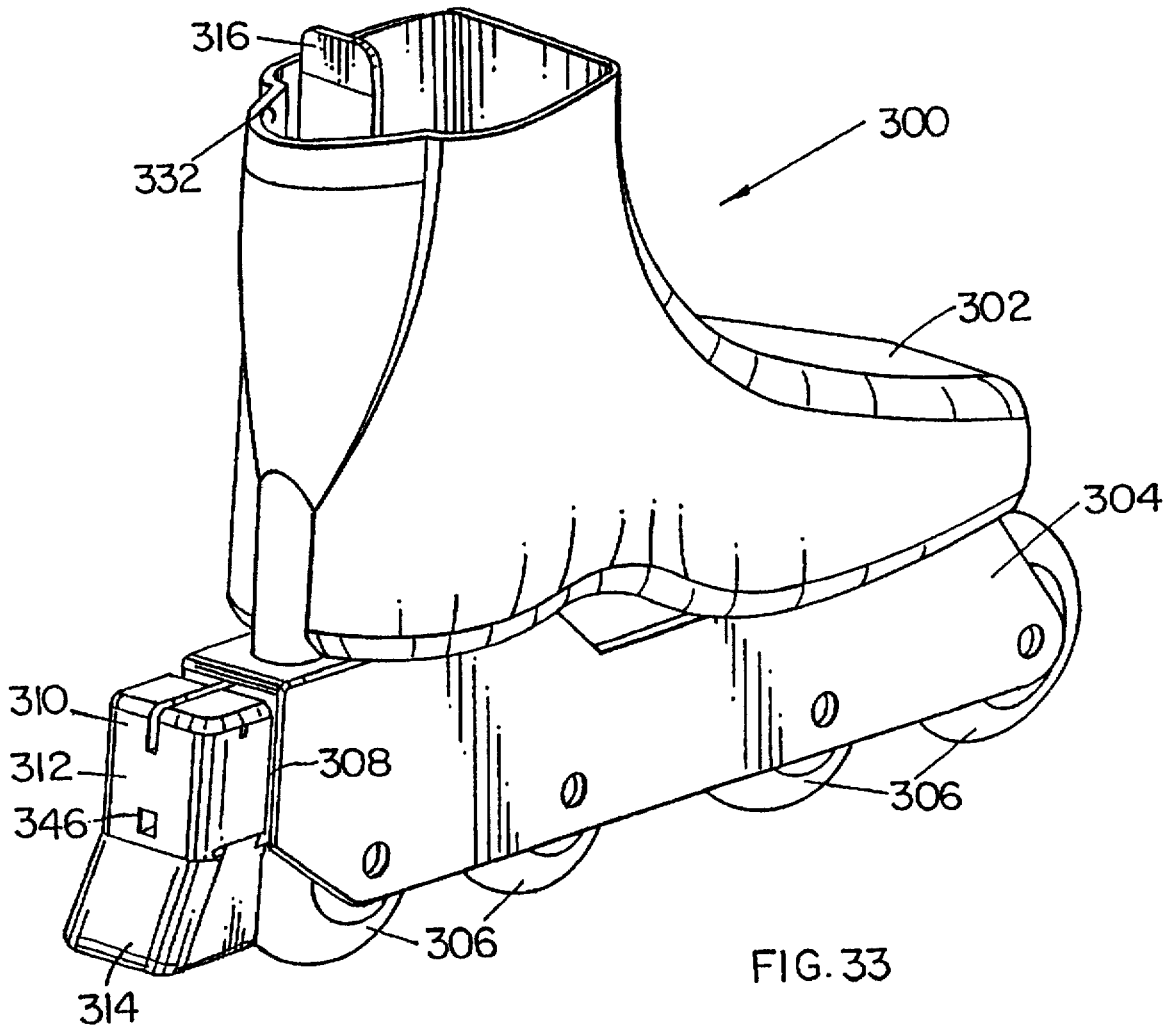
FIG. 33 is a perspective view of an exemplary roller skate having a brake which engages the ground upon movement of the user's leg while within a piece of footgear according to the present invention.

Referring now to FIG. 33, an exemplary embodiment of a roller skate 300 will be described. Skate 300 comprises a piece of footgear 302 which is securely attached to a frame 304, i.e. footgear 302 cannot move relative to frame 304. Attached to frame 304 are a plurality of wheels 306 which are axially aligned with each other. At a back end 308 of frame 304 is a braking mechanism 310. Braking mechanism 310 comprises a brake housing 312 and a braking pad 314. Held within the piece of footgear 302 is a paddle 316 which engages the user's lower calf when the foot is placed in the piece of footgear 302. As described in greater detail hereinafter, when the user moves the leg backward, paddle 316 is depressed causing braking pad 314 to move toward the skating surface.

Referring now to braking mechanism 31ration of braking mechanism 310 will be described in greater detail. Paddle 316 is pivotally attached to an elongate L-shaped member 318 by a pin 317 which extends through paddle 316. Member 318 in turn is attached to brake housing 312. Rigidly attached to elongate member 318 are a pair of pivot arms 320 and 322. Pivot arms 320, 322 are each provided with a pivot point 324 and 326, respectively. Pivot arms 320, 322 are pivotally connected to the piece of footgear 302 by pivot pins 328 (See FIG. 34). With this configuration, as paddle 316 is pressed backward toward back end 308, elongate member 318 pivots about pivot points 324, 326. In turn, braking mechanism 310 is pushed downward toward the skating surface. Paddle 316 may be depressed by the user's leg until braking pad 314 engages the skating surface to slow or stop the roller skate 300. Paddle 316 conveniently pivots relative to member 318 so that paddle 316 may comfortably conform to the user's leg as paddle 316 is depressed to push elongate member 318 downward by a pivot pins 313.

Figure 34:
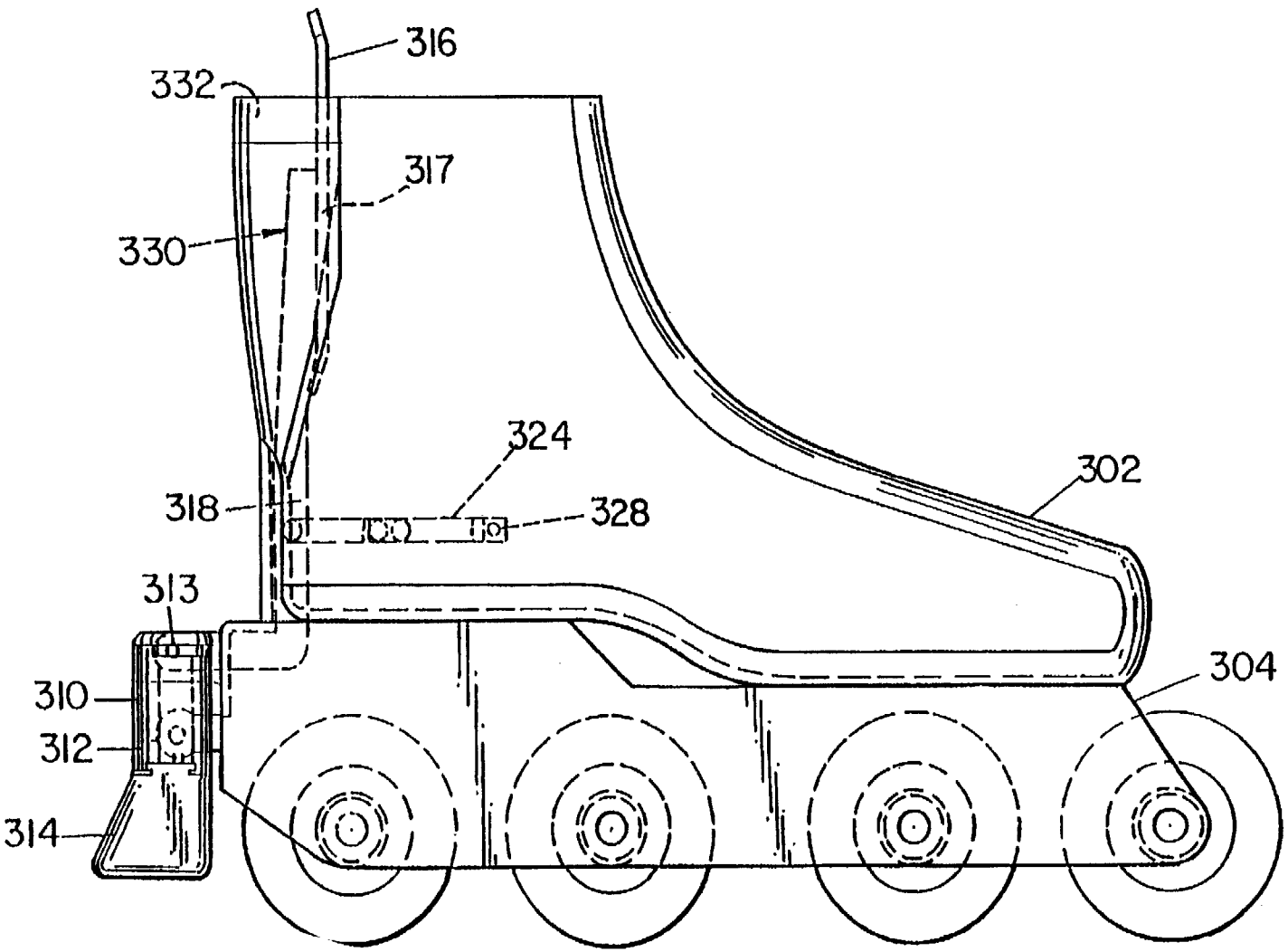
FIG. 34 is a side view of the roller skate of FIG. 33 showing the internal parts in phantom line.
Figure 35:
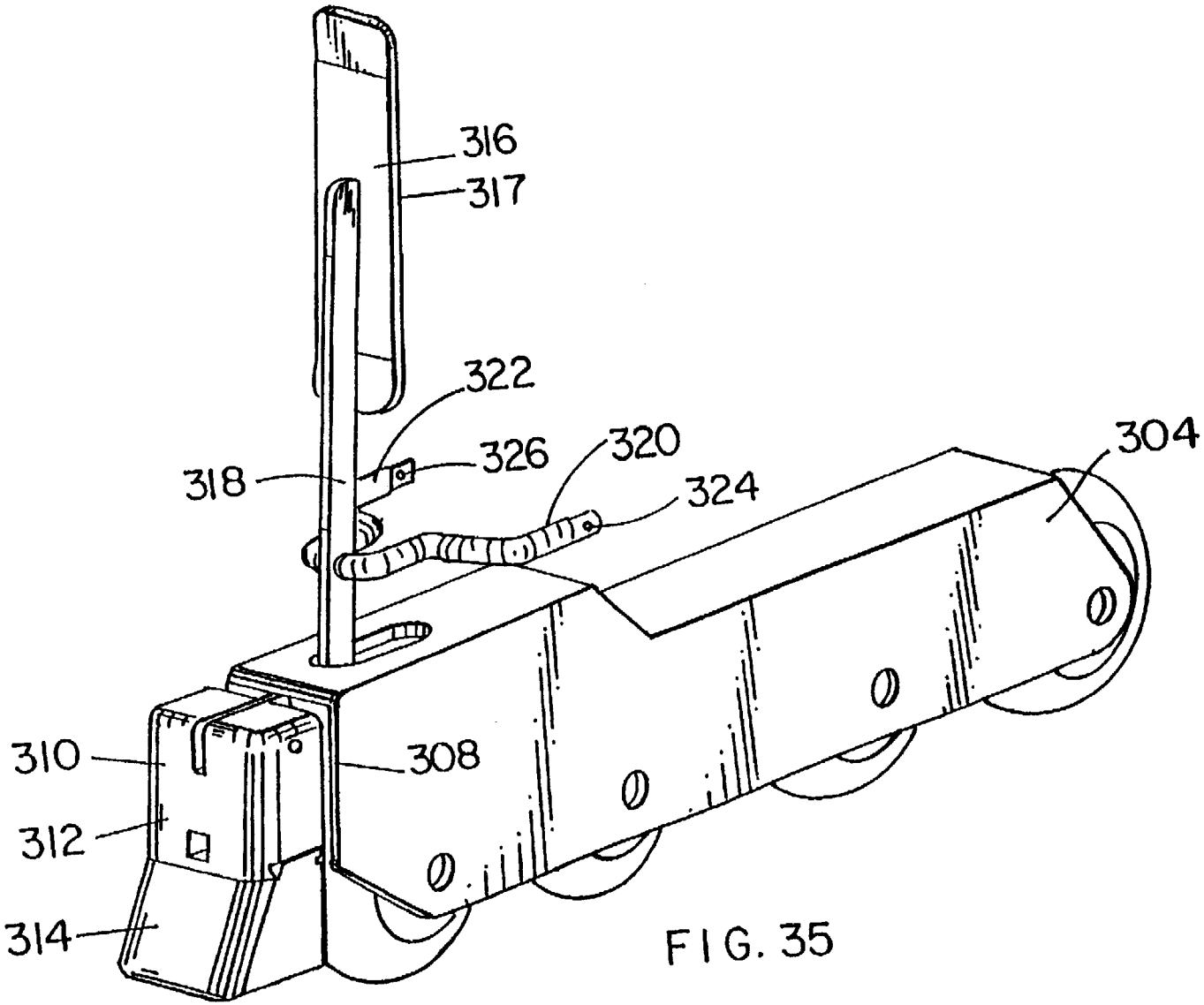
FIG. 35 is a perspective view of the braking system of the roller skate of FIG. 33.

As best shown in FIG. 34, roller skate 300 further includes a connection point 330 to which the interior lining (not shown) of the skate may be attached. In this manner, the interior lining serves as a biasing member which pushes paddle 316 away from back end 308 to maintain braking pad 314 above the skating surface. In this way, braking pad 314 will not be engaged with the ground until the user actively pushes paddle 316 backward. Conveniently, the piece of footgear 302 includes a recess 332 into which paddle 316 is received when pressed backward by the user. Other ways to alternatively bias paddle 316 include operably attaching paddle 316 to a pivoting cuff of the skate (if included), positioning a spring or other resilient member between the boot shell and the paddle 316, and the like.

Figure 36:
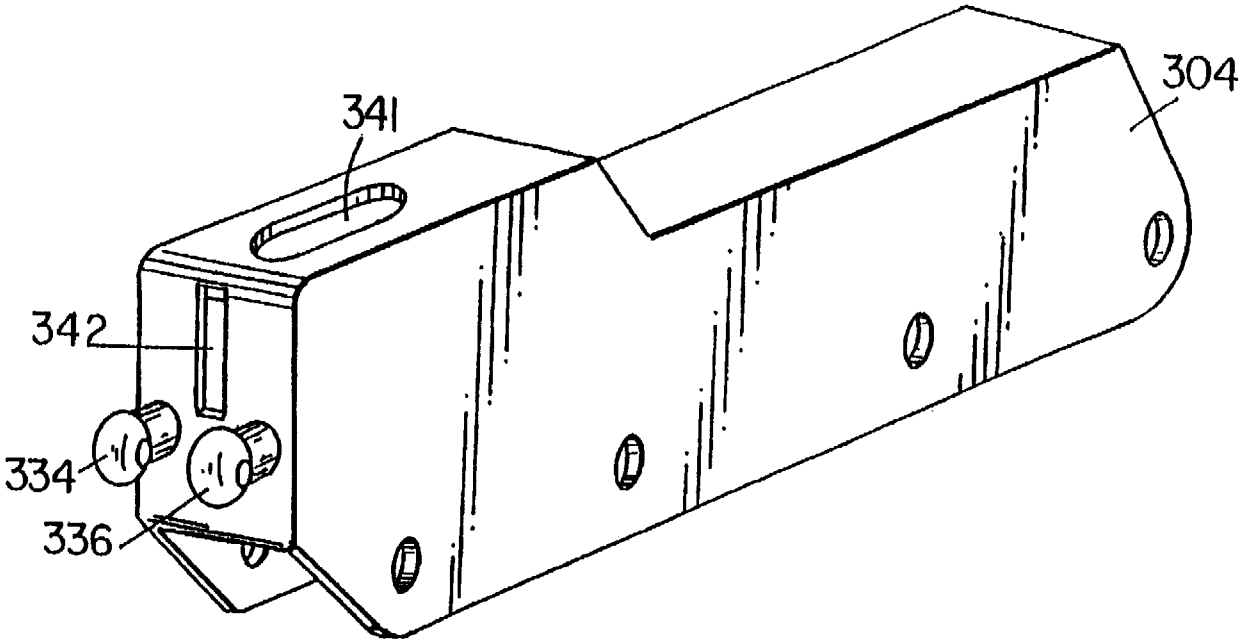
FIG. 36 is a perspective view of a frame of the roller skate of FIG. 33 having a pair of spherical members for interacting with a braking mechanism.
Figure 37:
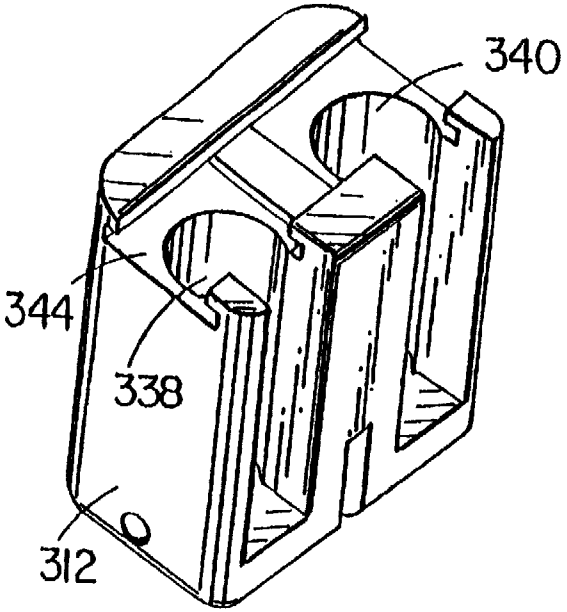
FIG. 37 is a perspective view of a brake housing which slides along the spherical members of FIG. 36.

Referring now to FIGS. 36 and 37, travel of braking mechanism 310 relative to frame 304 will be described. As shown in FIG. 36, frame 304 includes a pair of generally spherical elements 334 and 336. As shown in FIG. 37, brake housing 312 includes a pair of slots 338 and 340 through which spherically elements 334, 336 travel as brake housing 312 is moved up and down upon actuation of paddle 316. Travel of brake housing 312 relative to frame 304 is similar to that described in copending U.S. application Ser. No. 08/571,795, filed Dec. 13, 1995 (Attorney Docket No. 17251-6), the disclosure of which is herein incorporated by reference. Frame 304 includes apertures 341 and 342 through which elongate member 318 projects so that it may be attached to brake housing 312. Elongate member 318 moves up and down within aperture 342 upon actuation of paddle 316.

It will be appreciated that elements 334, 336 may be provided with other geometries, and slots 338, 340 may be fashioned accordingly to receive elements 334, 336. Further, the skate may employ only one of the spherical elements, or a plurality of elements. Still further, elements 334, 336 may be integrally formed as a part of frame 304 as shown. Alternatively, elements 334, 336 may be included as part of a housing which in turn is attached to the skate, such as is described in, for example, copending U.S. application Ser. No. 08/571,795, previously incorporated by reference.

Figure 42:
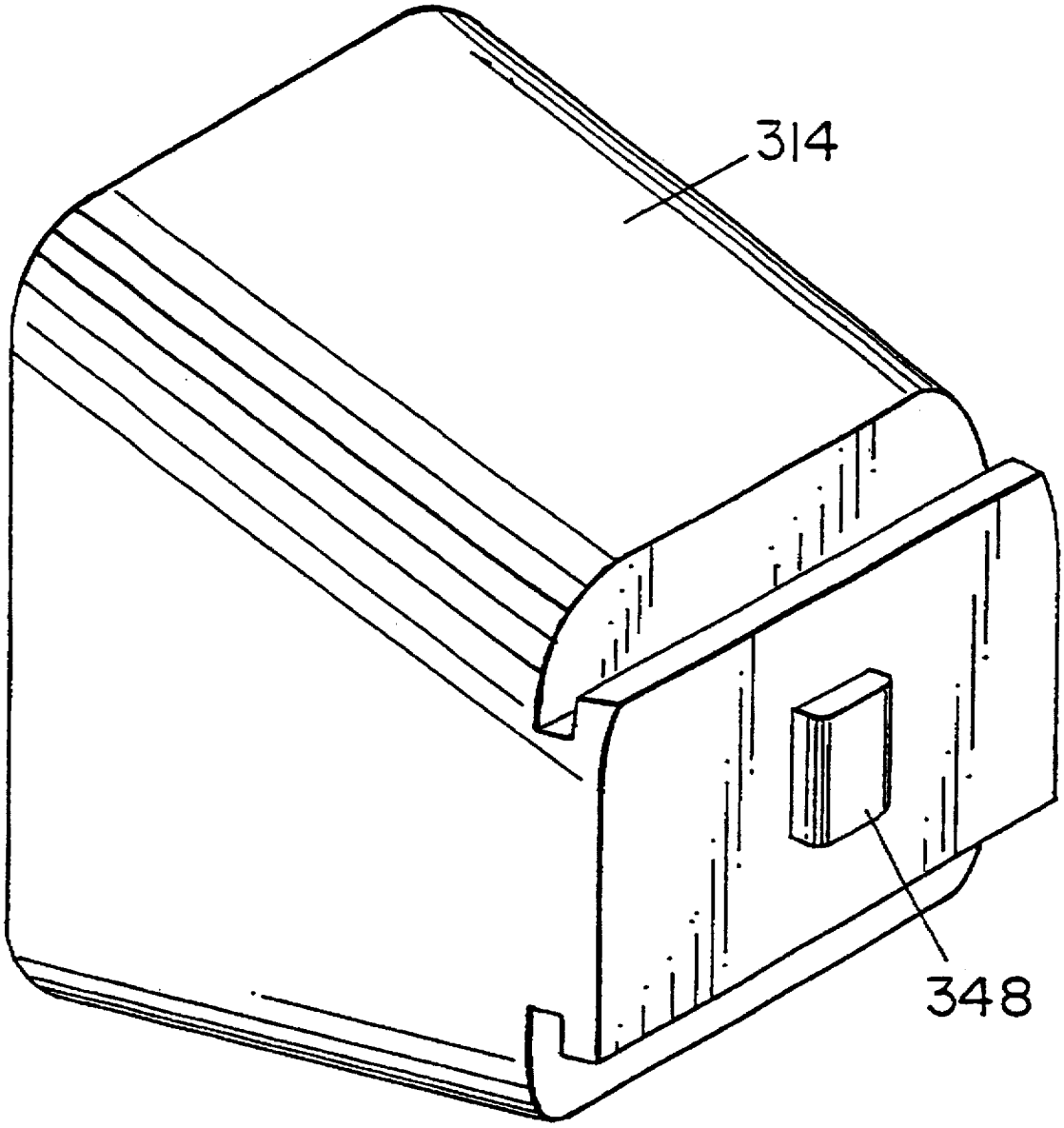
FIG. 42 is a perspective view of a brake pad which may be slidably engaged with the brake housing of FIG. 41.

As best shown in FIG. 37, brake housing 312 further includes a track 344 into which braking pad 314 slides. In this manner, braking pad 314 may easily be attached or removed to or from housing 312. As best shown in FIG. 33, housing 312 includes a hole 346 (see FIG. 33) which receives a tab 348 (see FIG. 42) to secure braking pad 314 to housing 312. Tab 348 may be depressed, i.e. tab 348 is resilient, to allow pad 314 to slide through housing 312 until tab 348 snaps into hole 346. To remove braking pad 314 from housing 312, a user simply depresses tab 348 within hole 346 and slides braking pad 314 from housing 312.

Braking pad 314 will preferably be constructed of a rubber or a polymeric material having a durometer in the range from about 50 to about 100 on the Shore A scale. Use of such materials is preferable in that the amount of vibration or "chattering" produced by braking pad 314 when engaging a skating surface can be greatly reduced depending upon the durometer of the material used. For example, in cold weather conditions a lower or higher durometer may be needed to reduce the amount of vibration produced when engaging a skating surface. The invention easily accommodates such a change by merely removing the braking pad from housing 312 and replacing it with another braking pad having a different durometer.

In summary, roller skate 300 includes a slidable braking mechanism 310 which is slid up and down relative to frame 304 simply be depressing paddle 316 with the user's leg. In this manner, braking pad 314 may be slid into engagement with the skating surface without requiring the heel or toe of the piece of footgear 302 to be raised or lowered.

Figure 38:
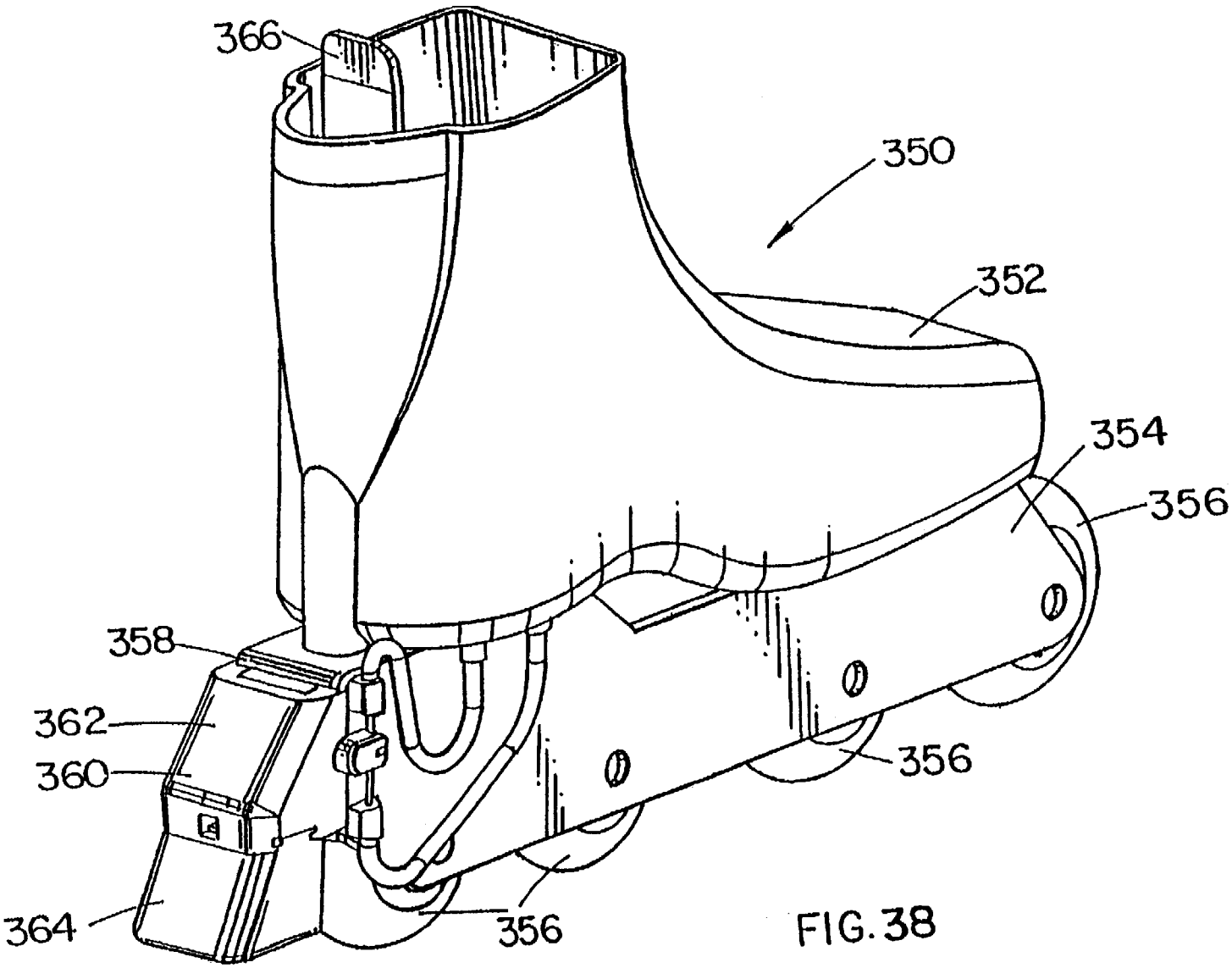
FIG. 38 is a perspective view of another exemplary roller skate having a cable actuated brake according to the present invention.

Referring now to FIG. 38, an alternative embodiment of a roller skate 350 will be described. Roller skate 350 includes a piece of footgear which is securely attached to a frame 354. Frame 354 in turn holds a plurality of axially aligned wheels 356 similar to the embodiment described in FIG. 33. Roller skate 350 includes a braking mechanism 360 at a back end 358. Braking mechanism 360 includes a brake housing 362 and a braking pad 314 (which may be identical to pad 314 of FIG. 33). Braking mechanism 310 slides up and down relative to frame 354 similar to braking mechanism 310 of FIG. 33 to place braking pad 364 into ground engagement. Roller skate 350 further includes a paddle 366 which, when depressed, will move braking mechanism 360 up and down.

Figure 39:
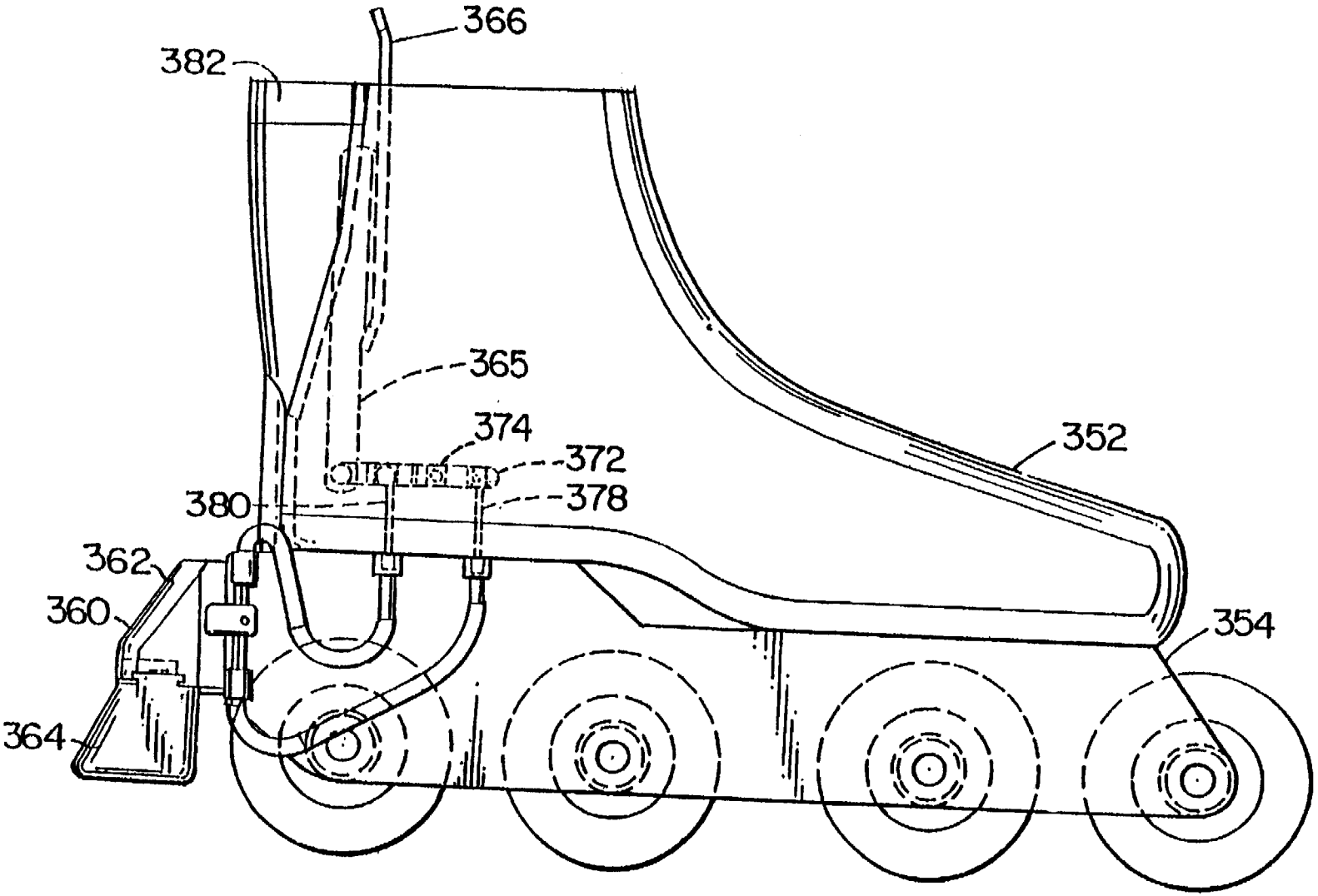
FIG. 39 is a side view of the roller skate of FIG. 38 showing the internal parts in phantom line.
Figure 40:
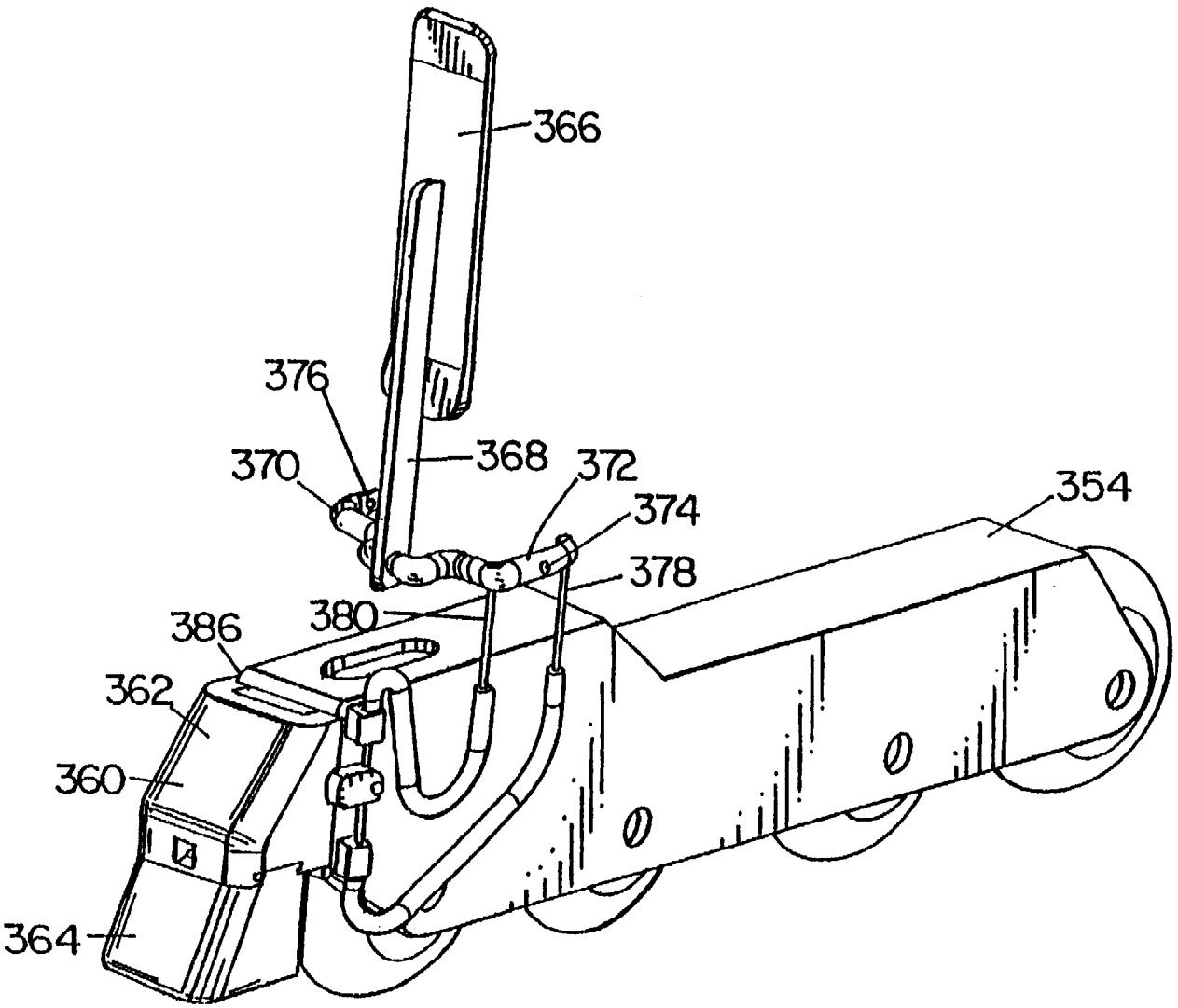
FIG. 40 is a perspective view of the braking system of the roller skate of FIG. 38.

Referring now to FIGS. 39 and 40, operation of braking mechanism 360 will be described in greater detail. Paddle 366 is fixedly attached to an elongate shaft 368 which in turn is attached to a pair of pivot arms 370 and 372. As best shown in FIG. 39, arms 370 and 372 are pivotally attached to a piece of footgear 352 by pivot points 374 and 376, respectively. Attached on opposite sides of pivot point 374 are a pair of cables 378 and 380. The opposite end of cables 378 and 380 are securely attached to housing 362.

With this configuration, as paddle 366 is depressed backward into a recess 382, pivot arms 370 and 372 pivot about pivot points 374 and 376 in a counterclockwise manner. In turn, cable 378 is pulled to slide braking mechanism 360 downward toward the skating surface. When paddle 36 is released, a biasing mechanism (not shown) similar to that described in connection with roller skate 300 moves paddle 366 out of recess 382 causing pivot arms 370 and 372 to move in a clockwise direction. In turn, cable 380 is pulled to lift braking mechanism 360 upward.

Figure 41:
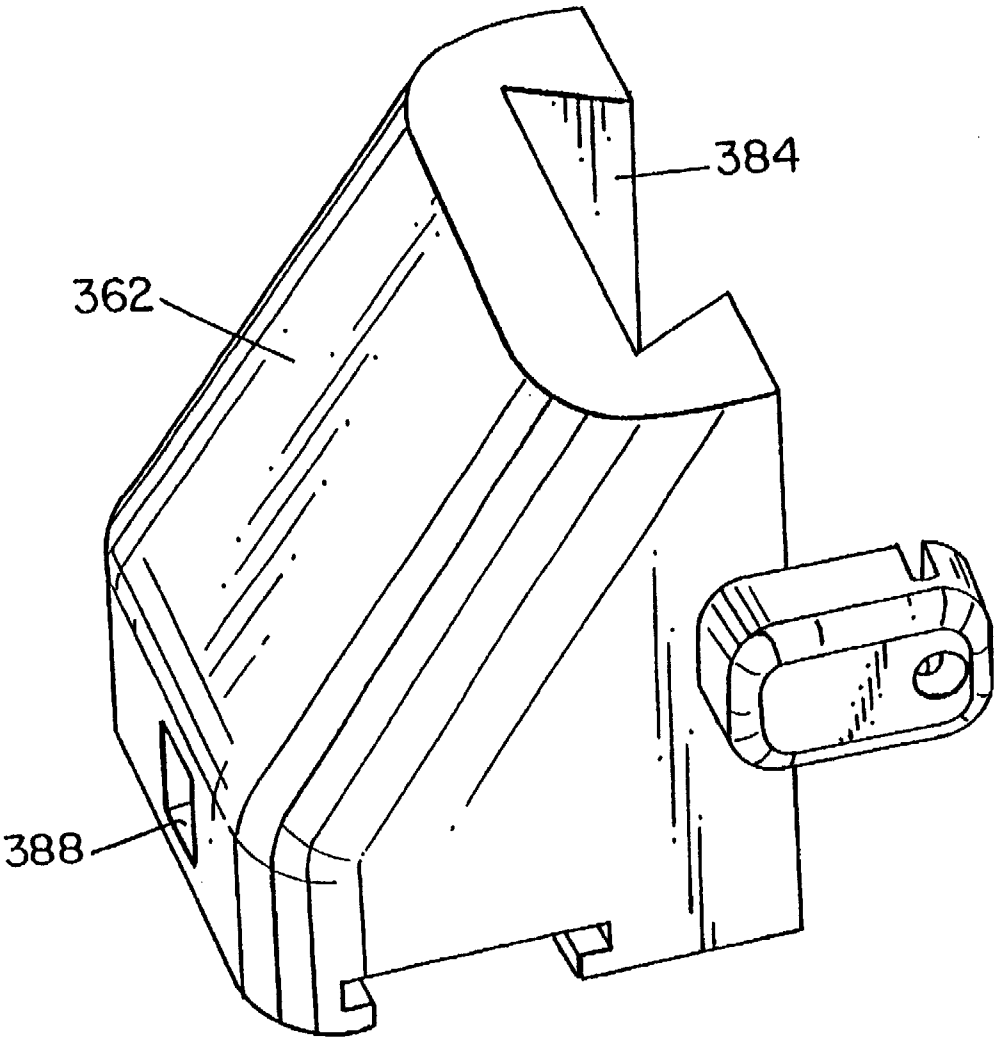
FIG. 41 is a perspective view of a brake housing of the braking system of FIG. 40.

As best shown in FIG. 41, housing 362 includes a dovetail track 384 which mates with a corresponding track 386 (see FIG. 40) of frame 354. In this way, housing 362 is able to freely slide up and down relative to frame 354 so that braking pad 364 may be moved into ground engagement without requiring the skate 350 to be tilted relative to the ground. Housing 362 further includes a hole 388 for receiving a tab (not shown) on braking pad 364 similar to that previously described in connection with brake pad 314 of roller skate 300.

Although not shown, it will be appreciated that the braking system included in roller skate 300 and roller skate 350 may be employed to actuate brakes employing carriages or rocker arms as previously described in this application. Moreover, it will be appreciated that the cables of roller skate 350 may be attached to either side of a roller skate having a pivotal cuff so that the braking pad may be moved into ground engagement by pivoting the cuff. Such a pivotal cuff is described in, for example, copending U.S. application Ser. No. 08/571,795 (Attorney Docket Number 17251-6), previously incorporated by reference.

It should be well understood that each of the several delivery mechanisms, variable force mechanisms, arresting mechanisms, brake surfaces, and actuators may be combined with each of the other components to provide a very large number of specific combinations. Although this disclosure has specifically described many combinations, it is not intended the combinations described should be taken to be the ones claimed in this invention. Instead, those specifically described combinations are meant to show the breadth of system of this invention and broadly to enable other combinations, all within the scope of this invention.

What is claimed is:

1. A roller skate system, comprising:

a roller skate comprising a frame having a longitudinal axis, a piece of footgear securely attached to the frame, and a plurality of wheels operably attached to the frame in alignment with the longitudinal axis, wherein a rear end of the piece of footgear extends at least partially over a rearmost wheel;

a braking mechanism operably attached to the roller skate, the braking system having a braking pad in alignment with the longitudinal axis, the braking pad being movable between a first position above a skating surface and a second position in contact with the skating surface, wherein the braking mechanism further comprises a slidable member which is attached directly to the braking pad, wherein the roller skate includes a fixed member, wherein the slidable member is slidably engaged with the fixed member such that the slidable member is positioned behind the rearmost wheel and may slide to move the braking pad between the first and the second positions; and an actuator which slides the slidable member to move the braking pad between the first and the second positions while the angle of the skate relative to the skating surface remains constant.

2. A system as in claim 1, wherein the actuator comprises a rigid elongate member having a region for interacting with a user's leg and a pivot arm, wherein the actuator is attached to the roller skate by a pivotal connection on the pivot arm, and wherein the actuator is operably connected to the braking mechanism so that movement of the user's leg moves the elongate member about the pivotal connection to move the braking pad.

3. A system as in claim 2, wherein the braking mechanism further comprises a braking element which holds the braking pad, and wherein the elongate member is directly attached to the braking element.

4. A system as in claim 2, further comprising a biasing member which biases the region for interacting with the user's leg against the user's leg.

5. A system as in claim 1, wherein the fixed member is integrally formed with the frame.

6. A system as in claim 5, wherein the fixed member comprises a spherical element which slides within a groove in the slidable member.

7. A system as in claim 1, wherein the braking mechanism includes a housing which holds the braking pad, and wherein the braking pad is removably attached to the housing.

8. A system as in claim 7, wherein the housing and the braking pad include mateable tracks such that the braking pad and housing may be separated by sliding them apart.

9. A system as in claim 8, wherein the braking pad includes a tab which interlocks with an aperture in the housing to secure the braking pad to the housing.

10. A system as in claim 7, wherein the braking pad is constructed of a material having a durometer reading in the range from about 50 to about 100 on the Shore A scale of hardness.

11. A braking system for a roller skate, the system comprising:

a housing; and a braking pad removably attached to the housing, wherein the housing and the braking pad include mateable tracks such that the braking pad and housing may be separated by sliding them apart, wherein the housing includes an aperture, and wherein the braking pad includes a resilient tab which expands into the aperture to secure the braking pad to the housing when the braking pad is slid into the housing.

12. A system as in claim 11, wherein the braking pad is constructed of a material having a durometer reading in the range from about 50 to about 100 on the Shore A scale of hardness.

13. A method for slowing a roller skate, the method comprising:

providing the roller skate with a frame, a piece of footgear securely attached to the frame, and a plurality of wheels operably attached to the frame, wherein a rear end of the piece of footgear extends at least partially over a rearmost wheel;

providing a braking mechanism which is operably attached to the roller skate, the braking system having a braking pad which is aligned with the frame and is movable between a first position above a skating surface and a second position in contact with the skating surface, wherein the braking mechanism further comprises a slidable member which is directly attached to the braking pad and is slidably engaged with the frame, and wherein the slidable member is positioned behind the rearmost wheel;

providing an actuator which is operably attached to the braking mechanism; and moving the user's leg while within the piece of footgear in a first direction to actuate the actuator and to slide the braking pad from the first position to the second position while the angle of the skate remains constant.

14. A method as in claim 13, wherein the skate further includes a rigid elongate member having a region for interacting with a user's leg and a pivot arm, wherein the pivot arm is pivotally attached to the roller skate at a pivot point, and wherein the elongate member is operably attached to the braking mechanism.

15. A method as in claim 14, wherein the braking mechanism further comprises a braking element which holds the braking pad, and wherein the elongate member is directly attached to the braking element, and further comprising moving the user's leg while within the piece of footgear to swing the elongate member about the pivot point to move the braking pad from the first position to the second position.

16. A method for slowing a roller skate, the method comprising:

providing the roller skate with a frame, a piece of footgear securely attached to the frame, and a plurality of wheels operably attached to the frame;

providing a braking mechanism which is operably attached to the roller skate, the braking system having a braking pad which is movable between a first position above a skating surface and a second position in contact with the skating surface;

providing a rigid elongate member having a region for interacting with a user's leg and a pivot arm, wherein the pivot arm is pivotally attached to the roller skate at a pivot point, and wherein the elongate member is operably attached to the braking mechanism; and moving the user's leg while within the piece of footgear in a first direction to pivot the pivot arm about the pivot point and to move the braking pad from the first position to the second position;

wherein the braking mechanism further comprises a braking element which holds the braking pad, and wherein the elongate member is directly attached to the braking element, and further comprising moving the user's leg while within the piece of footgear to swing the elongate member about the pivot point to move the braking pad from the first position to the second position.

17. A roller skate system, comprising:

a roller skate comprising a frame having a longitudinal axis, a piece of footgear securely attached to the frame, and a plurality of wheels operably attached to the frame in alignment with the longitudinal axis;

a braking mechanism operably attached to the roller skate, the braking system having a braking pad in alignment with the longitudinal axis, the braking pad being movable between a first position above a skating surface and a second position in contact with the skating surface; and an actuator which moves the braking pad between the first and the second positions while the angle of the skate relative to the skating surface remains constant;

wherein the actuator comprises a rigid elongate member having a region for interacting with a user's leg and a pivot arm, wherein the actuator is attached to the roller skate by a pivotal connection on the pivot arm, and wherein the actuator is operably connected to the braking mechanism so that movement of the user's leg moves the elongate member about the pivotal connection to move the braking pad;

wherein the braking mechanism further comprises a braking element which holds the braking pad, and wherein the elongate member is directly attached to the braking element.

18. A roller skate system, comprising:

a roller skate comprising a frame having a longitudinal axis, a piece of footgear securely attached to the frame, and a plurality of wheels operably attached to the frame in alignment with the longitudinal axis;

a braking mechanism operably attached to the roller skate, the braking system having a braking pad in alignment with the longitudinal axis, the braking pad being movable between a first position above a skating surface and a second position in contact with the skating surface; and an actuator which moves the braking pad between the first and the second positions while the angle of the skate relative to the skating surface remains constant;

wherein the actuator comprises a rigid elongate member having a region for interacting with a user's leg and a pivot arm, wherein the actuator is attached to the roller skate by a pivotal connection on the pivot arm, and wherein the actuator is operably connected to the braking mechanism so that movement of the user's leg moves the elongate member about the pivotal connection to move the braking pad;

wherein the braking member further comprises a slidable member which is attached to the braking pad, wherein the roller skate includes a fixed member, wherein the slidable member is slidably engaged with the fixed member such that the slidable member may slide to move the braking pad between the first and the second positions when actuated by the actuator.

* * * * *